US008884508B2

(12) United States Patent
Pickard et al.

(10) Patent No.: US 8,884,508 B2
(45) Date of Patent: Nov. 11, 2014

(54) SOLID STATE LIGHTING DEVICE INCLUDING MULTIPLE WAVELENGTH CONVERSION MATERIALS

(75) Inventors: Paul Kenneth Pickard, Morrisville, NC (US); Gerald H. Negley, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 428 days.

(21) Appl. No.: 13/292,577

(22) Filed: Nov. 9, 2011

(65) Prior Publication Data

US 2013/0114242 A1 May 9, 2013

(51) Int. Cl.

| | |
|---|---|
| ***H05B 33/14*** | (2006.01) |
| ***H05B 33/02*** | (2006.01) |
| ***F21V 9/00*** | (2006.01) |
| ***F21V 9/16*** | (2006.01) |
| ***H05B 33/08*** | (2006.01) |
| ***F21V 3/04*** | (2006.01) |
| *F21V 29/00* | (2006.01) |
| *F21K 99/00* | (2010.01) |
| *F21Y 101/02* | (2006.01) |
| *F21Y 113/00* | (2006.01) |

(52) U.S. Cl.

CPC ..... *F21V 9/16* (2013.01); *F21V 29/2206* (2013.01); *F21K 9/1375* (2013.01); *F21Y 2101/02* (2013.01); *H05B 33/0803* (2013.01); *F21K 9/135* (2013.01); *F21K 9/137* (2013.01); *H05B 33/0857* (2013.01); *F21V 3/0481* (2013.01); *F21Y 2113/005* (2013.01)

USPC ..... 313/501; 362/231; 362/249.02; 362/84

(58) Field of Classification Search

CPC ... H01L 33/504; H01L 25/0753; H01L 33/50; H01L 33/507; H01L 33/502; H01L 33/501; H01L 2933/0041; H01L 33/08; F21Y 2101/02; F21Y 2105/001; F21Y 2113/005; F21Y 2113/002; F21K 9/56; H05B 33/0857; H01S 3/2391; G02F 1/133603; G02F 1/133609

See application file for complete search history.

(56) References Cited

U.S. PATENT DOCUMENTS

| | | | |
|---|---|---|---|
| 3,875,456 | A | 4/1975 | Kano et al. |
| 5,959,316 | A | 9/1999 | Lowery |

(Continued)

FOREIGN PATENT DOCUMENTS

| | | | |
|---|---|---|---|
| DE | 10233050 | A1 | 5/2004 |
| JP | 2004-071726 | A | 3/2004 |

(Continued)

OTHER PUBLICATIONS

International Search Report and the Written Opinion of the International Searching Authority, or the Declaration corresponding to International Patent Application No. PCT/US2012/064174 dated Mar. 29, 2013.

(Continued)

*Primary Examiner* — Donald Raleigh

(74) *Attorney, Agent, or Firm* — Withrow & Terranova, P.L.L.C.; Vincent K. Gustafson

(57) ABSTRACT

A solid state lighting device includes a solid state light emitter combined with a lumiphor to form a solid state light emitting component, at least one lumiphor spatially segregated from the light emitting component, and another lumiphor and/or solid state light emitter. The solid state light emitting component may include a blue shifted yellow component with a higher color temperature, but in combination with the other elements the aggregated emissions from the lighting device have a lower color temperature. Multiple white or near-white components may be provided and arranged to stimulate one or more lumiphors spatially segregated therefrom.

56 Claims, 20 Drawing Sheets

(56) References Cited

U.S. PATENT DOCUMENTS

| | | | |
|---|---|---|---|
| 6,350,041 | B1 | 2/2002 | Tarsa et al. |
| 6,577,073 | B2 | 6/2003 | Shimizu et al. |
| 7,005,679 | B2 | 2/2006 | Tarsa et al. |
| 7,061,454 | B2 | 6/2006 | Sasuga et al. |
| 7,083,302 | B2 | 8/2006 | Chen et al. |
| 7,213,940 | B1 | 5/2007 | Van De Ven et al. |
| 7,564,180 | B2 | 7/2009 | Brandes et al. |
| 7,791,092 | B2 | 9/2010 | Tarsa et al. |
| 7,821,023 | B2 | 10/2010 | Yuan et al. |
| 7,901,107 | B2 | 3/2011 | Van de Ven et al. |
| 8,018,135 | B2 | 9/2011 | Van de Ven et al. |
| 2003/0067773 | A1 | 4/2003 | Marshall et al. |
| 2004/0218387 | A1 | 11/2004 | Gerlach |
| 2006/0067073 | A1 | 3/2006 | Ting |
| 2007/0170447 | A1 | 7/2007 | Negley et al. |
| 2007/0223219 | A1 | 9/2007 | Medendorp, Jr. et al. |
| 2009/0039365 | A1 | 2/2009 | Andrews et al. |
| 2009/0039375 | A1 | 2/2009 | LeToquin et al. |
| 2009/0050908 | A1 | 2/2009 | Yuan et al. |
| 2009/0108269 | A1 | 4/2009 | Negley et al. |
| 2009/0195137 | A1 | 8/2009 | Brandes et al. |
| 2010/0079059 | A1 | 4/2010 | Roberts et al. |
| 2010/0157583 | A1 | 6/2010 | Nakajima |
| 2010/0219428 | A1 | 9/2010 | Jung et al. |
| 2010/0301360 | A1 | 12/2010 | Van de Ven et al. |
| 2011/0012143 | A1 | 1/2011 | Yuan et al. |
| 2011/0018026 | A1 * | 1/2011 | Konno et al. ..... 257/100 |
| 2011/0050125 | A1 | 3/2011 | Medendorp, Jr. et al. |
| 2011/0148327 | A1 | 6/2011 | Van de Ven et al. |
| 2011/0180780 | A1 * | 7/2011 | Yoo et al. ..... 257/13 |
| 2011/0221330 | A1 | 9/2011 | Negley et al. |
| 2011/0222277 | A1 | 9/2011 | Negley et al. |
| 2011/0248296 | A1 * | 10/2011 | Choi et al. ..... 257/89 |
| 2012/0051045 | A1 * | 3/2012 | Harbers et al. ..... 362/235 |
| 2012/0098437 | A1 * | 4/2012 | Smed ..... 315/152 |
| 2012/0243222 | A1 | 9/2012 | van de Ven et al. |
| 2013/0093362 | A1 * | 4/2013 | Edwards ..... 315/313 |

FOREIGN PATENT DOCUMENTS

| | | | | |
|---|---|---|---|---|
| JP | 2004-080046 | A | 3/2004 | |
| JP | 2007-258620 | A | 10/2007 | |
| JP | 2007-266579 | A | 10/2007 | |
| KR | 10-2007-0068709 | A | 7/2007 | |
| KR | 2010-034184 | A | 2/2010 | |
| WO | WO-2008053012 | A1 | 5/2008 | |
| WO | WO 2010122312 | A1 * | 10/2010 | ..... F21K 99/00 |
| WO | WO 2011/109097 | A1 | 9/2011 | |

OTHER PUBLICATIONS

Battaglia, David, High Quality, High Efficiency LED Lighting Without Compromises, NNCrystal US Corporation, Downloaded Sep. 19, 2011.

* cited by examiner

| name | excite | x | y | u' | v' | nm (dom) | nm (peak) | Comp | Purity |
|---|---|---|---|---|---|---|---|---|---|
| Y108 | 452p | 0.3155 | 0.3269 | 0.2006 | 0.4676 | 487 | 452 | 584 | 7% |
| CASN2 BR01 | 452p | 0.5524 | 0.2818 | 0.4187 | 0.4806 | -495 | 639 | 515 | 62% |

| | | | | | | | | | |
|---|---|---|---|---|---|---|---|---|---|
| BSR Sim | 17 | 0.5524 | 0.2818 | 0.4187 | 0.4806 | -495.0 | 639 | 515 | 62% |
| IuAG1 | 42 | 0.3748 | 0.5563 | 0.1680 | 0.5609 | 562.0 | 543 | 360 | 77% |
| BSY sim2 Y108 | 16 | 0.3155 | 0.3269 | 0.2006 | 0.4676 | 487.0 | 452 | 584 | 7% |
| MixAB | | 0.4622 | 0.4212 | 0.2593 | 0.5317 | 583 | 633 | 484 | 65% |
| MixBC Sv1 | | 0.3558 | 0.4827 | 0.1761 | 0.5376 | 561 | 543 | 360 | 48% |
| output Str1 Str2 | 2 | 0.4338 | 0.4030 | 0.2490 | 0.5205 | 583 | 632 | 360 | 51% |
| | | 0.4030 | | | | | | | |
| SSL 3000K | 2 | 0.4338 | 0.4030 | 0.2490 | 0.5205 | | | | |

FIG._13A

| name | excite | CCT | FWHM | mW/ part | L/prt | Vf | If | pwr | l/w |
|---|---|---|---|---|---|---|---|---|---|
| Y108 | 452p | 6366 | 21 | 432.8 | 137.4 | 3.10 | 0.370 | 1.15 | 119.7 |
| CASN2 BR01 | 452p | Over2 | 90 | 155.2 | 22.8 | 3.10 | 0.370 | 1.15 | 19.9 |

| | | | | | | | | | | |
|---|---|---|---|---|---|---|---|---|---|---|
| BSR Sim | 17 | Over2 | 90 | 155.2 | 22.8 | 3.10 | 0.370 | 1.15 | 19.9 |
| luAG1 | 42 | 4813 | 115 | 123.6 | 54.8 | 12.00 | 0.050 | 0.600 | 91.4 |
| BSY sim2 Y108 | 16 | 6366 | 21 | 432.8 | 137.4 | 3.10 | 0.370 | 1.15 | 119.7 |
| MixAB | | 2749 | 152 | 1898.3 | 505.9 | 7.55 | 0.000 | 12.10 | 41.8 |
| MixBC Sv1 | | 5022 | 118 | 1061.0 | 433.5 | 7.55 | 0.000 | 4.50 | 96.4 |
| output Str1 Str2 | 2 | 3027 | 176 | 2194.8 | 600.0 | 0.00 | 0.000 | 12.88 | 46.6 |
| | | | | | | | | | |
| SSL 3000K | 2 | 3027 | 3030 | | | | | | |

FIG._13B

| name | excite | mW | mW% | L | L% | mA | W | LEP | WPE | Bin |
|---|---|---|---|---|---|---|---|---|---|---|
| Y108 | 452p | 0.0 | 0% | 0.0 | 0% | 0.000 | 0.000 | 318 | 38% | <XL |
| CASN2 BR01 | 452p | 0.0 | 0% | 0.0 | 0% | 0.000 | 0.000 | 147 | 14% | <XL |
| BSR Sim | 17 | 1133.7 | 51.7% | 166.53 | 27.8% | 2.705 | 8.385 | 147 | 14% | <XL |
| luAG1 | 42 | 764.6 | 34.8% | 339.35 | 56.6% | 0.309 | 3.712 | 444 | 21% | >XP |
| BSY sim2 Y108 | 16 | 296.4 | 13.5% | 94.12 | 15.7% | 0.254 | 0.786 | 318 | 38% | <XL |
| MixAB | | 0.0 | 0% | 0.00 | 0.0% | 0.000 | 0.000 | 266 | 16% | XB |
| MixBC Sv1 | | 0.0 | 0% | 0.00 | 0.0% | 0.000 | 0.000 | 409 | 24% | XM |
| output Str1 Str2 | 2 | 2194.8 | 100% | 600.0 | 100% | | 12.9 | 273 | 17% | XD |
| SSL 3000K | 2 | | | | | | | | | |

FIG._13C

| LED OUTPUT | |
|---|---|
| x | 0.4338 |
| y | 0.4030 |
| CCTn | 3045 |
| Δ u'n'Target | 0.0000 |
| CRI Ra | 97.4 |
| R9 | 97 |
| CQS | 96.1 |
| Lumens | 600.0 |
| LEP | 273 |
FIG._14A
| FIXTURE OUTPUT | |
|---|---|
| PSU eff | 85% |
| Optic Eff | 85% |
| Photopic Lumens | 510 |
| Scotopic Lumens | 753 |
| Power | 15.2 |
| LPW | 33.6 |
| du'v' BBL | 0.0007 |
| GAI | 61% |
| SP ration | 1.25 |
| Pupil Lumens | 499 |
FIG._14B
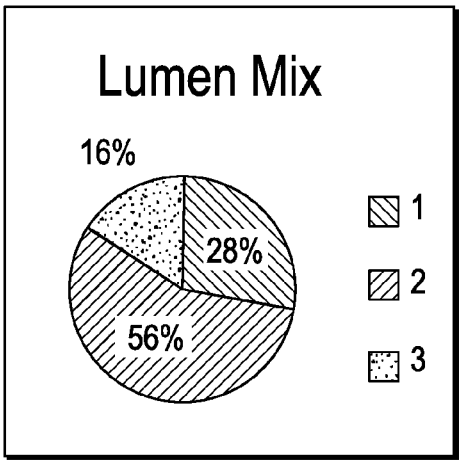
FIG._15A
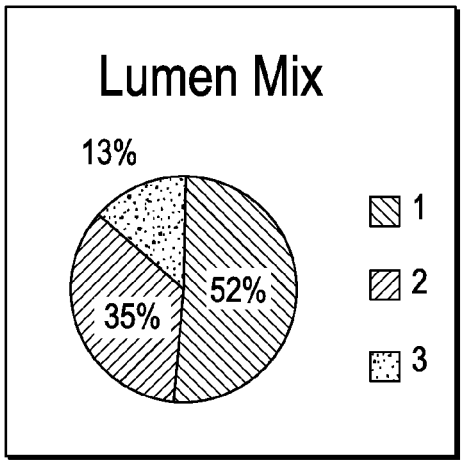
FIG._15B

| name | excite | x | y | u' | v' | nm (dom) | nm (peak) | Comp | Purity |
|---|---|---|---|---|---|---|---|---|---|
| YAG #108 | 452p | 0.3155 | 0.3269 | 0.2006 | 0.4676 | 487 | 452 | 581 | 7% |
| LuAG543 | 452p | 0.3583 | 0.5541 | 0.1605 | 0.5583 | 560 | 536 | 360 | 63% |

| | | | | | | | | | | |
|---|---|---|---|---|---|---|---|---|---|---|
| Red | | 1 | 0.6964 | 0.3035 | 0.5306 | 0.5204 | 623.0 | 632 | 498 | 100% |
| Phos LuAG 543 | | 17 | 0.3583 | 0.5541 | 0.1605 | 0.5583 | 560.0 | 536 | 360 | 63% |
| Phos YAG # 108 | | 16 | 0.3155 | 0.3269 | 0.2006 | 0.4676 | 487.0 | 452 | 581 | 7% |
| MixAB | | | 0.4839 | 0.4610 | 0.2559 | 0.5485 | 581 | 632 | 482 | 81% |
| MixBC | Sv1 | | 0.3279 | 0.3927 | 0.1859 | 0.5009 | 550 | 452 | 623 | 17% |
| output | Str1 Str2 | 2 | 0.3818 | 0.3797 | 0.2248 | 0.5031 | 579 | 632 | 575 | 28% |
| | | | 0.3797 | | | | | | | |
| SSL 4000K | | 4 | 0.3818 | 0.3797 | 0.2248 | 0.5031 | | | | |

FIG._19A

| name | excite | CCT | FWHM | mW/ part | L/prt | Vf | If | pwr | l/w |
|---|---|---|---|---|---|---|---|---|---|
| YAG #108 | 452p | 6366 | 21 | 432.8 | 137.4 | 3.10 | 0.370 | 1.15 | 119.7 |
| LuAG 543 | 452p | 5081 | 111 | 255.0 | 113.7 | 3.10 | 0.370 | 1.15 | 99.1 |

| | | | | | | | | | | |
|---|---|---|---|---|---|---|---|---|---|---|
| Red | 1 | Over2 | 17 | 5.1 | 1.0 | 2.20 | 0.009 | 0.02 | 50.0 |
| Phos LuAG 543 | 17 | 5081 | 111 | 255.0 | 113.7 | 3.10 | 0.370 | 1.148 | 99.1 |
| Phos YAG #108 | 16 | 6366 | 21 | 432.8 | 137.4 | 3.10 | 0.370 | 1.15 | 119.7 |
| MixAB | | 2748 | 18 | 841.7 | 286.8 | 2.65 | 0.000 | 3.59 | 79.9 |
| MixBC Sv1 | | 5661 | 117 | 1472.2 | 529.9 | 3.10 | 0.000 | 4.80 | 110.3 |
| output Str1 Str2 | 2 | 3985 | 30 | 1828.0 | 600.0 | 0.00 | 0.000 | 6.21 | 96.7 |
| | | | | | | | | | |
| SSL 4000K | 4 | 3985 | 3990 | | | | | | |

FIG._19B

| name | excite | mW | mW% | L | L% | mA | W | LEP | WPE | Bin |
|---|---|---|---|---|---|---|---|---|---|---|
| YAG #108 | 452p | 0.0 | 0% | 0.0 | 0% | 0.000 | 0.000 | 318 | 38% | <XL |
| LuAG 543 | 452p | 0.0 | 0% | 0.0 | 0% | 0.000 | 0.000 | 446 | 22% | >XP |
| Red | 1 | 355.8 | 19.5% | 70.14 | 11.7% | 0.638 | 1.403 | 197 | 25% | XD |
| Phos LuAG 543 | 17 | 485.9 | 26.6% | 216.66 | 36.1% | 0.706 | 2.187 | 446 | 22% | >XP |
| Phos YAG #108 | 16 | 986.3 | 54.0% | 313.20 | 52.2% | 0.844 | 2.616 | 318 | 38% | <XL |
| MixAB | | 0.0 | 0% | 0.00 | 0.0% | 0.000 | 0.000 | 341 | 23% | XP |
| MixBC Sv1 | | 0.0 | 0% | 0.00 | 0.0% | 0.000 | 0.000 | 360 | 31% | XH |
| output Str1 Str2 | 2 | 1828.0 | 100% | 600.0 | 100% | | 6.2 | 328 | 29% | XH |
| SSL 4000K | 4 | | | | | | | | | |

FIG._19C

| LED OUTPUT | |
|---|---|
| x | 0.3818 |
| y | 0.3797 |
| CCTn | 3985 |
| Δ u'n'Target | 0.0000 |
| CRI Ra | 93.1 |
| R9 | 84 |
| CQS | 92.5 |
| Lumens | 600.0 |
| LEP | 328 |
FIG._20A
| FIXTURE OUTPUT | |
|---|---|
| PSU eff | 85% |
| Optic Eff | 85% |
| Photopic Lumens | 510 |
| Scotopic Lumens | 894 |
| Power | 7.3 |
| LPW | 69.9 |
| du'v' BBL | 0.0013 |
| GAI | 81% |
| SP ration | 1.49 |
| Pupil Lumens | 593 |
FIG._20B
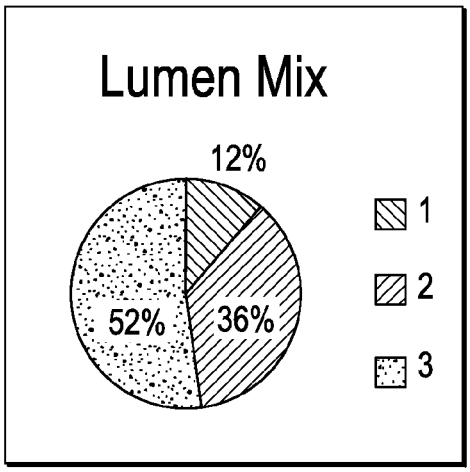
FIG._21A
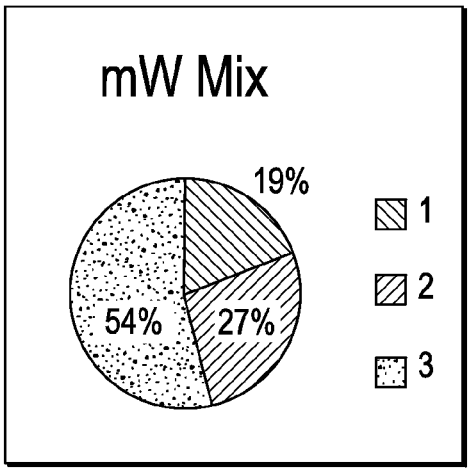
FIG._21B

SOLID STATE LIGHTING DEVICE INCLUDING MULTIPLE WAVELENGTH CONVERSION MATERIALS

TECHNICAL FIELD

The present invention relates to solid state lighting devices, including devices with multiple wavelength conversion materials stimulated by at least one solid state light emitter, and methods of making and using same.

BACKGROUND

Solid state light sources may be utilized to provide colored (e.g., non-white) or white LED light (e.g., perceived as being white or near-white). White solid state emitters have been investigated as potential replacements for white incandescent lamps due to reasons including substantially increased efficiency and longevity. Longevity of solid state emitters is of particular benefit in environments where access is difficult and/or where change-out costs are extremely high.

A solid state lighting device may include, for example, at least one organic or inorganic light emitting diode ("LED") or a laser. A solid state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid state emitter depends on the materials of the active layers thereof. Solid state light sources provide potential for very high efficiency relative to conventional incandescent or fluorescent sources, but present significant challenges in simultaneously achieving good efficacy, good color reproduction, and color stability (e.g., with respect to variations in operating temperature).

Color reproduction is commonly measured using Color Rendering Index (CRI) or average Color Rendering Index (CRI Ra). In the calculation of the CRI, the color appearance of 14 reflective samples is simulated when illuminated by a reference illuminant and the test source. The difference in color appearance $\Delta E_i$, for each sample, between the test and reference illumination, is computed in CIE 1964 W*U*V* uniform color space. It therefore provides a relative measure of the shift in surface color and brightness of an object when lit by a particular lamp. The general color rendering index CRI Ra is a modified average utilizing the first eight indices, all of which have low to moderate chromatic saturation. The CRI Ra equals 100 (a perfect score) if the color coordinates and relative brightness of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80) for general illumination use where the colors of objects are not important. For some general interior illumination, a CRI Ra>80 is acceptable. CRI Ra>85, and more preferably, CRI Ra>90, provides greater color quality.

CRI only evaluates color rendering, or color fidelity, and ignores other aspects of color quality, such as chromatic discrimination and observer preferences. The Color Quality Scale (CQS) developed by National Institute of Standards and Technology (NIST) is designed to incorporate these other aspects of color appearance and address many of the shortcomings of the CRI, particularly with regard to solid-state lighting. The method for calculating the CQS is based on modifications to the method used for the CRI, and utilizes set of 15 Munsell samples having much higher chroma than the CRI indices.

Aspects relating to the present inventive subject matter may be better understood with reference to the 1931 CIE (Commission International de l'Eclairage) Chromaticity Diagram, which is well-known and readily available to those of ordinary skill in the art. The 1931 CIE Chromaticity Diagram maps out the human color perception in terms of two CIE parameters x and y. The spectral colors are distributed around the edge of the outlined space, which includes all of the hues perceived by the human eye. The boundary line represents maximum saturation for the spectral colors.

The chromaticity coordinates (i.e., color points) that lie along the black body locus obey Planck's equation: $E(\lambda)=A\lambda^{-5}/(e^{B/T}-1)$, where E is the emission intensity, A is the emission wavelength, T the color temperature of the blackbody, and A and B are constants. Color coordinates that lie on or near the Planckian black body locus (BBL) yield pleasing white light to a human observer. The 1931 CIE Diagram includes temperature listings along the blackbody locus (embodying a curved line emanating from the right corner). These temperature listings show the color path of a blackbody radiator that is caused to increase to such temperatures. As a heated object becomes incandescent, it first glows reddish, then yellowish, then white, and finally bluish. This occurs because the wavelength associated with the peak radiation of the blackbody radiator becomes progressively shorter with increased temperature. Illuminants that produce light on or near the BBL can thus be described in terms of their color temperature.

The term "white light" or "whiteness" does not clearly cover the full range of colors along the BBL since it is apparent that a candle flame and other incandescent sources appear yellowish, i.e., not completely white. Accordingly, the color of illumination may be better defined in terms of correlated color temperature (CCT) and in terms of its proximity to the BBL. The pleasantness and quality of white illumination decreases rapidly if the chromaticity point of the illumination source deviates from the BBL by a distance of greater than 0.01 in the x, y chromaticity system. This corresponds to the distance of about 4 MacAdam ellipses, a standard employed by the lighting industry. A lighting device emitting light having color coordinates that are within 4 MacAdam step ellipses of the BBL and that has a CRI Ra>80 is generally acceptable as a white light for illumination purposes. A lighting device emitting light having color coordinates within 7 MacAdam ellipses of the BBL and that has a CRI Ra>70 is used as the minimum standards for many other white lighting devices including compact fluorescent and solid state lighting devices.

General illumination generally has a color temperature between 2,000 K and 10,000 K, with the majority of lighting devices for general illumination being between 2,700 K and 6,500 K. The white area proximate to (i.e., within approximately 8 MacAdam ellipses of) of the BBL and between 2,500 K and 10,000 K, is shown in FIG. 1 (based on the 1931 CIE diagram).

Because light that is perceived as white is necessarily a blend of light of two or more colors (or wavelengths), and light emitting diodes are inherently narrow-band emitters, no single light emitting diode junction has been developed that can produce white light. A representative example of a white LED lamp includes a blue LED chip (e.g., made of InGaN and/or GaN), coated with a phosphor (typically YAG:Ce or BOSE). Blue LEDs made from InGaN exhibit high efficiency (e.g., external quantum efficiency as high as 70%). In a blue LED/yellow phosphor lamp, a blue LED chip may produce an emission with a wavelength of about 450 nm, and the phosphor may produce yellow fluorescence with a peak wavelength of about 550 nm upon receipt of the blue emission. Part of the blue ray emitted from the blue LED chip passes through the phosphor, while another portion of the blue ray is absorbed by the phosphor, which becomes excited and emits a yellow ray. The viewer perceives an emitted mixture of blue and yellow light (sometimes termed 'blue shifted yellow' or 'BSY' light) as cool white light. A BSY device typically exhibits good efficacy but only medium CRI Ra (e.g., between 60 and 75), or very good CRI Ra and low efficacy. Cool white LEDs have a color temperature of approximately 5000K, which is generally not visually comfortable for general illumination, but may be desirable for the illumination of commercial goods or advertising and printed materials.

Various methods exist to enhance cool white light to increase its warmth. Acceptable color temperatures for indoor use are typically in a range of from 2700-3500K; however, warm white LED devices may be on the order of only half as efficient as cool white LED devices. To promote warm white colors, an orange phosphor or a combination of a red phosphor (e.g., $CaAlSiN_3$ ('CASN') based phosphor) and yellow phosphor (e.g., Ce:YAG or YAG:Ce) can be used in conjunction with a blue LED. Cool white emissions from a BSY element (including a blue emitter and yellow phosphor) may also be supplemented with a red LED (with such combination being referred to hereinafter as "BSY+R"), such as disclosed by U.S. Pat. No. 7,095,056 to Vitta, et al. and U.S. Pat. No. 7,213,940 to Negley et al., to provide warmer light. While such devices permit the correlative color temperature (CCT) to be changed, the CRI of such devices may be reduced at elevated color temperatures.

As an alternative to stimulating a yellow phosphor with a blue LED, another method for generating white emissions involves combined use of red, green, and blue ("RGB") light emitting diodes in a single package. The combined spectral output of the red, green, and blue emitters may be perceived by a user as white light. Each "pure color" red, green, and blue diode typically has a full-width half-maximum (FWHM) wavelength range of from about 15 nm to about 30 nm. Due to the narrow FWHM values of these LEDs (particularly the green and red LEDs), aggregate emissions from the red, green, and blue LEDs exhibit very low color rendering in general illumination applications. Moreover, use of AlInGaP-based red LEDs in conjunction with nitride-based blue and/or green LEDs entails color stability issues, since the efficacy of red LEDs declines more substantially at elevated operating temperatures than does the efficacy of blue and green LEDs.

Another example of a known white LED lamp includes one or more ultraviolet (UV)-based LEDs combined with red, green, and blue phosphors. Such lamps typically provide reasonably high color rendering, but exhibit low efficacy due to substantial Stokes losses.

The highest efficiency LEDs today are blue LEDs made from InGaN. Commercially available devices have external quantum efficiency (EQE) as great as 60%. The highest efficiency phosphors suitable for LEDs today are YAG:Ce and BOSE phosphor with a peak emission around 555 nm. YAG:Ce has a quantum efficiency of >90% and is an extremely robust and well-tested phosphor. White LED lamps made with InGaN-based blue LEDs and YAG:Ce phosphors typically have a CRI Ra of between 70 and 80.

Given the extensive amount of effort that has been expended to date to develop highly efficient BSY components (e.g., including blue LEDs and YAG:Ce or BOSE phosphors), and the number of commercially available devices of this type, it would be desirable to utilize such components as a starting point for creating lighting devices with improved color rendering such as may be embodied in warm white light emitting devices. It would also be desirable to provide improved color rendering (e.g., warm white) lighting devices with improved efficacy, with improved color stability at high flux, and/or with longer duration of service.

SUMMARY

The present invention relates in various aspects to lighting devices including a first light emitting component that includes a first electrically activated solid state light emitter and a first wavelength conversion material, wherein a second wavelength conversion material spatially segregated from the first light emitting component, and the device includes at least one of a second electrically activated solid state light emitter and a third wavelength conversion material, with other novel features and/or elements.

In one aspect, the invention relates to a lighting device comprising: at least one first light emitting component including at least one electrically activated first solid state light emitter adapted to emit a peak wavelength in a range of from 430 to 480 nm, and including at least one first wavelength conversion material covering at least a portion of the at least one first solid state light emitter and adapted to emit a peak wavelength in a range of from 550 to 599 nm; a second wavelength conversion material spatially segregated from the at least one first light emitting component, arranged to receive emissions from the at least one first light emitting component, and adapted to emit a peak wavelength in a range of from 500 to 560 nm; and electrically activated second solid state light emitter adapted to emit a peak wavelength in a range of from 600 to 660 nm.

In another aspect, the invention relates to a lighting device comprising: at least one first light emitting component including at least one electrically activated first solid state light emitter and at least one first wavelength conversion material covering at least a portion of the at least one first solid state light emitter, wherein a combination of light exiting the at least one first light emitting component including emissions generated by the at least one first solid state light emitter and the at least one first wavelength conversion material produces a mixture of light having x, y coordinates on a 1931 CIE Chromaticity Diagram that define a first point within ten MacAdam ellipses of at least one first reference point on the blackbody locus of a 1931 CIE Chromaticity Diagram; a second wavelength conversion material spatially segregated from the at least one first light emitting component, arranged to receive emissions from the at least one first light emitting component and responsively convert a portion of the emissions from the at least one first light emitting component to generate second wavelength conversion material emissions; and at least one of the following items (a) and (b): (a) an electrically activated second solid state light emitter adapted to emit a peak wavelength differing from (i) a peak wavelength of the at least one first solid state light emitter, (ii) a peak wavelength of the at least one first wavelength conversion material, and (iii) a peak wavelength of the second wavelength conversion material; and (b) a third wavelength conversion material spatially segregated from the at least one first light emitting component, arranged to receive emissions from the at least one first light emitting component and responsively convert a portion of the emissions from the at least one first light emitting component to generate third wavelength conversion material emissions including a peak wavelength differing from (i) a peak wavelength of the at least one first solid state light emitter, (ii) a peak wavelength of the at least one first wavelength conversion material, and (iii) a peak wavelength of the second wavelength conversion material; wherein a combination of light exiting the lighting device produces a mixture of light having x, y coordinates on a 1931 CIE Chromaticity Diagram that define a second point within four MacAdam ellipses of at least one second reference point on the blackbody locus of a 1931 CIE Chromaticity Diagram, and wherein a color temperature of the first reference point is at least 1000 K greater than a color temperature of the second reference point.

In another aspect, the invention relates to a lighting device comprising: a first light emitting component including an electrically activated first solid state light emitter adapted to emit a peak wavelength in a range of from 430 to 480 nm, and including a first wavelength conversion material covering at least a portion of the first solid state light emitter and adapted to emit a peak wavelength in a range of from 550 to 599 nm; a second light emitting component including an electrically activated second solid state light emitter adapted to emit a peak wavelength in a range of from 430 to 480 nm, and including a second wavelength conversion material covering at least a portion of the second solid state light emitter and adapted to emit a peak wavelength in a range of from 550 to 599 nm; a third wavelength conversion material spatially segregated from the first light emitting component, arranged to receive emissions from the first light emitting component, and adapted to emit a peak wavelength in a range of from 500 to 549 nm; and a fourth wavelength conversion material spatially segregated from the second light emitting component, arranged to receive emissions from the second light emitting component, and adapted to emit a peak wavelength in a range of from 600 to 660 nm.

Further aspects relating to methods of illuminating an object, a space, or an environment utilizing at least one lighting device as disclosed herein.

In another aspect, any of the foregoing aspects, and/or various separate aspects and features as described herein, may be combined for additional advantage.

Other aspects, features and embodiments of the invention will be more fully apparent from the ensuing disclosure and appended claims.

BRIEF DESCRIPTION OF THE DRAWINGS

FIGS. 13A-13C provide tabulated simulation parameters and results for a simulation of a light emitting component including at least one blue LED (452 nm peak wavelength) overlaid with a YAG phosphor, and arranged to stimulate a remote (i.e., spatially separated) mixture of a LuAG green phosphor (543 nm peak wavelength) and a CASN red phosphor (640 nm peak wavelength), yielding CRI Ra of 97 and luminous efficacy of about 60 lumens per watt at a color temperature of approximately 3000K.

FIG. 14A provides tabulated results for LED output of the simulation of FIGS. 13A-13C.

FIG. 14B provides tabulated results for fixture output for the simulation of FIGS. 13A-13C.

FIG. 15A is a pie chart providing relative lumen outputs (in percent) for red (1), green (2), and blue (3) fractions of the simulation of FIGS. 13A-13C.

FIG. 15B is a pie chart providing relative radiant intensity (in percent) allocated to red (1), green (2), and blue (3) fractions of the simulation of FIGS. 13A-13C.

FIGS. 19A-19C provide tabulated simulation parameters and results for a simulation of a light emitting component including at least one blue LED (452 nm peak wavelength) overlaid with a YAG phosphor, arranged to stimulate a remote (i.e., spatially separated) LuAG green phosphor, in combination with an AlInGaP-based red LED, yielding CRI Ra of greater than 85 and improved luminous efficacy (relative to the simulation of FIGS. 13A-13C) at a color temperature of approximately 4000K.

FIG. 20A provides tabulated results for LED output of the simulation of FIGS. 19A-19C.

FIG. 20B provides tabulated results for fixture output for the simulation of FIGS. 19A-19C.

FIG. 21A is a pie chart providing relative lumen outputs (in percent) for red (1), green (2), and blue (3) fractions of the simulation of FIGS. 19A-19C.

FIG. 21B is a pie chart providing relative radiant intensity (in percent) allocated to red (1), green (2), and blue (3) fractions of the simulation of FIGS. 19A-19C.

DETAILED DESCRIPTION

Figure 1:
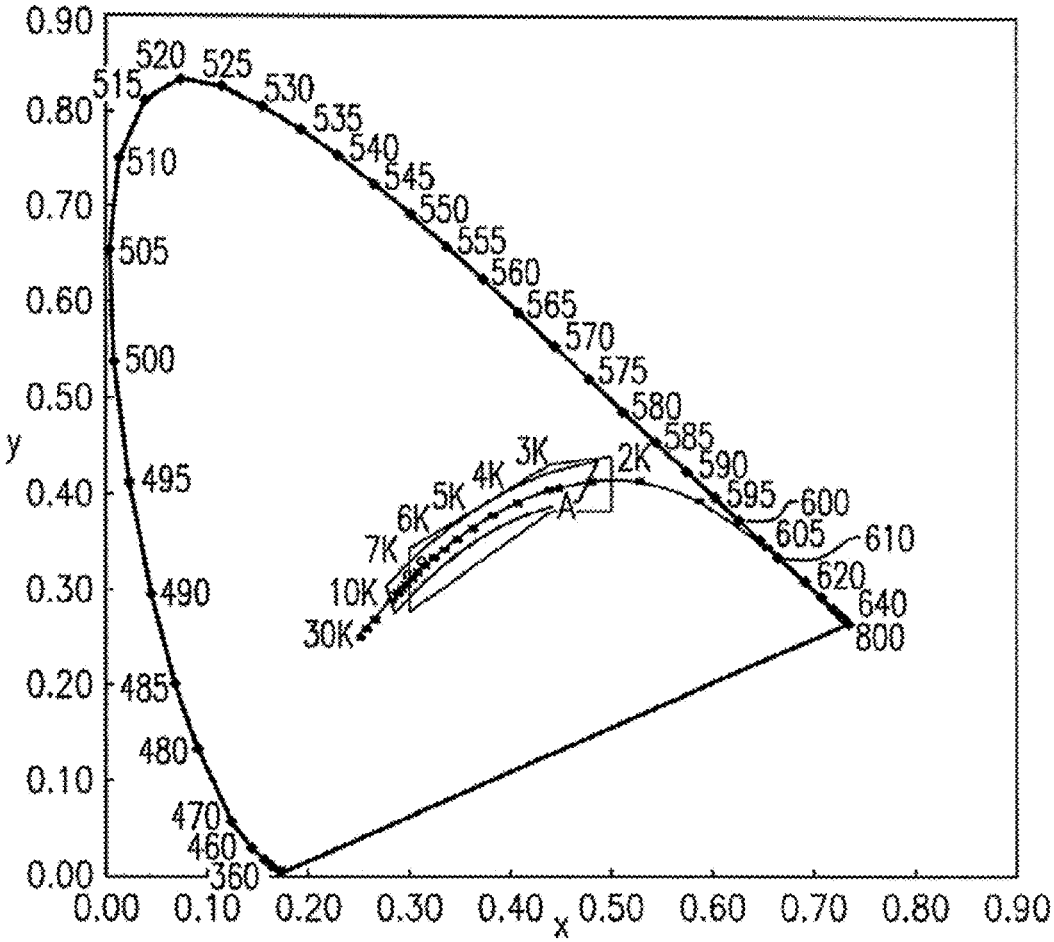
FIG. 1 is a 1931 CIE Chromaticity Diagram including representation of the black body locus, and further illustrating an approximately white area bounding the black body locus.

The present invention relates in certain aspects to lighting devices including at least one lumiphor-converted light emitting component (e.g., BSY emitter) arranged to stimulate a spatially segregated wavelength conversion material (or lumiphor), and including at least one supplemental electrically activated solid state emitter and/or additional spatially segregated wavelength conversion material. Relative to use of a single lumiphor converted light emitting component such as BSY emitter (which may be a premanufactured component), the resulting combination may be used to lower the color temperature and enhance color rendering of the aggregated output.

Unless otherwise defined, terms (including technical and scientific terms) used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Embodiments of the invention are described herein with reference to cross-sectional, perspective, and/or plan view illustrations that are schematic illustrations of idealized embodiments of the invention. Variations from the shapes of the illustrations as a result, for example, of manufacturing techniques and/or tolerances, are to be expected, such that embodiments of the invention should not be construed as limited to particular shapes illustrated herein. This invention may be embodied in many different forms and should not be construed as limited to the specific embodiments set forth herein. In the drawings, the size and relative sizes of layers and regions may be exaggerated for clarity.

Unless the absence of one or more elements is specifically recited, the terms "comprising," "including," and "having" as used herein should be interpreted as open-ended terms that do not preclude the presence of one or more elements.

It will be understood that when an element such as a layer, region or substrate is referred to as being "on" another element, it can be directly on the other element or intervening elements may be present. Moreover, relative terms such as "beneath" or "overlies" may be used herein to describe a relationship of one layer or region to another layer or region relative to a substrate, emitter, or another element layer as illustrated in the figures. It will be understood that these terms are intended to encompass different orientations of the device in addition to the orientation depicted in the figures. The term "directly" is utilized to mean that there are no intervening elements.

The terms "electrically activated emitter" and "emitter" as used herein refers to any device capable of producing visible or near visible (e.g., from infrared to ultraviolet) wavelength radiation, including but not limited to, xenon lamps, mercury lamps, sodium lamps, incandescent lamps, and solid state emitters, including diodes (LEDs), organic light emitting diodes (OLEDs), and lasers.

The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

Solid state light emitting devices according to embodiments of the invention may include III-V nitride (e.g., gallium nitride) based LEDs or lasers fabricated on a silicon carbide substrate or a sapphire substrate such as those devices manufactured and sold by Cree, Inc. of Durham, N.C. Such LEDs and/or lasers may be configured to operate such that light emission occurs through the substrate in a so-called "flip chip" orientation. Such LEDs and/or lasers may also be devoid of substrates (e.g., following substrate removal).

Solid state light emitters may be used individually or in combination with one or more lumiphoric materials (e.g., phosphors, scintillators, lumiphoric inks, quantum dots) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

The expression "correlative color temperature" or "CCT" is used according to its well-known meaning to refer to the temperature of a blackbody that is, in a well-defined sense (i.e., can be readily and precisely determined by those skilled in the art), nearest in color.

The expression "peak wavelength", as used herein, means (1) in the case of a solid state light emitter, to the peak wavelength of light that the solid state light emitter emits if it is illuminated, and (2) in the case of a luminescent material, the peak wavelength of light that the luminescent material emits if it is excited.

A solid state emitter as disclosed herein can be saturated or non-saturated. The term "saturated" as used herein means having a purity of at least 85%, with the term "purity" having a well-known meaning to those skilled in the art, and procedures for calculating purity being similarly well-known in the art.

A wide variety of wavelength conversion materials (e.g., luminescent materials, also known as lumiphors or luminophoric media, e.g., as disclosed in U.S. Pat. No. 6,600,175 and U.S. Patent Application Publication No. 2009/0184616), are well-known and available to persons of skill in the art. Examples of luminescent materials (lumiphors) include phosphors, scintillators, day glow tapes, nanophosphors, quantum dots (e.g., such as provided by NNCrystal US Corp. (Fayetteville, Ark.)), and inks that glow in the visible spectrum upon illumination with (e.g., ultraviolet) light. Inclusion of lumiphors in LED devices has been accomplished by providing layers (e.g., coatings) of such materials over solid state emitters and/or by dispersing luminescent materials to a clear encapsulant (e.g., epoxy-based or silicone-based curable resin or other polymeric matrix) arranged to cover one or more solid state light emitters. One or more luminescent materials useable in devices as described herein may be down-converting or up-converting, or can include a combination of both types.

Various embodiments include lumiphoric materials and lumiphor support elements that are spatially segregated (i.e., remotely located) from one or more solid state emitters. In certain embodiments, such spatial segregation may involve separation of a distance of at least about 1 mm, at least about 2 mm, at least about 5 mm, or at least about 10 mm. In certain embodiments, conductive thermal communication between a spatially segregated lumiphoric material and one or more electrically activated emitters is not substantial. Lumiphoric materials may be supported by or within one or more lumiphor support elements, such as (but not limited to) glass layers or discs, optical elements, or layers of similarly translucent or transparent materials capable of being coated with or embedded with lumiphoric material. In certain embodiments, lumiphoric material may be embedded or dispersed in a lumiphor support element.

Embodiments of the present invention provide include emitting device structures with discrete lumiphor-bearing regions on a surface remotely located from at least one electrically activated solid state emitter. The term "discrete" means that the lumiphor-bearing regions are separate, substantially nonoverlapping (except for manufacturing tolerances) regions. In some embodiments discrete lumiphor-bearing regions may be provided as a pattern of phosphors on a lens, reflective surface, or the like.

Some embodiments of the present invention may use solid state emitters, emitter packages, fixtures, luminescent materials/elements, power supplies, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272, and co-pending U.S. patent application Ser. No. 13/292,541 entitled "Lighting Device Providing Improved Color Rendering" and filed concurrently herewith; with the disclosures of the foregoing patents, published patent applications, and pending patent application being hereby incorporated by reference as if set forth fully herein.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or backlighting (e.g., backlight poster, signage, LCD displays), bulb replacements (e.g., for replacing AC incandescent lights, low voltage lights, fluorescent lights, etc.), outdoor lighting, security lighting, exterior residential lighting (wall mounts, post/ column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting device.

The present inventive subject matter further relates in certain embodiments to an illuminated enclosure (the volume of which can be illuminated uniformly or non-uniformly), comprising an enclosed space and at least one lighting device as disclosed herein, wherein the lighting device illuminates at least a portion of the enclosure (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Certain embodiments of the present invention relate to use of solid state emitter packages. A solid state emitter package typically includes at least one solid state emitter chip that is enclosed with packaging elements to provide environmental and/or mechanical protection, color selection, and light focusing, as well as electrical leads, contacts or traces enabling electrical connection to an external circuit. Encapsulant material, optionally including lumiphoric material, may be disposed over solid state emitters in a solid state emitter package. Multiple solid state emitters may be provided in a single package. A package including multiple solid state emitters may include at least one of the following: a single leadframe arranged to conduct power to the solid state emitters, a single reflector arranged to reflect at least a portion of light emanating from each solid state emitter, a single submount supporting each solid state emitter, and a single lens arranged to transmit at least a portion of light emanating from each solid state emitter.

Individual emitters or groups of emitters in a solid state emitter package (e.g., wired in series) may be separately controlled. Multiple solid state emitter packages may be arranged in a single solid state lighting device. Individual solid state emitter packages or groups of solid state emitter packages (e.g., wired in series) may be separately controlled. Separate control of individual emitters, groups of emitters, individual packages, or groups of packages, may be provided by independently applying drive currents to the relevant components with control elements known to those skilled in the art. In one embodiment, at least one control circuit a may include a current supply circuit configured to independently apply an on-state drive current to each individual solid state emitter, group of solid state emitters, individual solid state emitter package, or group of solid state emitter packages. Such control may be responsive to a control signal (optionally including at least one sensor arranged to sense electrical, optical, and/or thermal properties and/or environmental conditions), and a control system may be configured to selectively provide one or more control signals to the at least one current supply circuit. In various embodiments, current to different circuits or circuit portions may be pre-set, user-defined, or responsive to one or more inputs or other control parameters.

The present invention relates in various aspects to lighting devices including at least one lumiphor-converted light emitting component (e.g., BSY emitter) arranged to stimulate a spatially segregated wavelength conversion material (or lumiphor), and including at least one supplemental electrically activated solid state emitter and/or additional spatially segregated wavelength conversion material. Supplemental emissions with peak wavelengths in the ranges of yellow-green (e.g., 500-560 nm, or preferably 500-549 nm) and red (600-660 nm) are desirable. Relative to use of a single lumiphor converted light emitting component such as BSY emitter (which may be a premanufactured component), the resulting combination may be used to lower the color temperature and enhance color rendering of the aggregated output.

At least one supplemental solid state emitter may be independently controllable relative to a solid state light emitting component. In certain embodiments, a supplemental solid state light emitter is adapted to emit a peak wavelength in a range of from 600 to 660 nm. In certain embodiments, a supplemental solid state light emitter is arranged as a lumiphor-converted solid state light emitter component (e.g., a BSY component), such that a resulting device includes multiple lumiphor converted solid state light emitter components.

In certain embodiments, at least one spatially segregated lumiphor may be patterned on a lumiphor support element (e.g., lens, reflector, substrate, covering element, optical element, or other surface) in any desirable regular or irregular pattern (e.g., including but not limited to stripes, checkerboards, polygonal geometric patterns, patterns involving curved shapes, dot patterns, and the like) overlying all or only portions of one or more solid state emitter chips (or one or more solid state emitter components including in combination a solid state emitter chip and a wavelength conversion material, such as a BSY emitter). Lumiphors may be patterned on a lumiphor support element using any desirable patterning technique, such as may include inkjet printing, use of stencils or masks (such as may include use of photomasks), rollers, powder coating/curing, and the like. In different embodiments, a lumiphor support element may be patterned with lumiphors prior to addition to a LED lighting device, or a lumiphor support element may be patterned with lumiphors following addition to the LED lighting device. Examples of lighting devices with patterned lumiphors and/or discrete lumiphor-bearing regions on remote surfaces thereof are disclosed, for example, in U.S. Patent Application Publication No. 2010/0301360A1 to van de Ven, et al.; U.S. Patent Application Publication No. 2009/0039365 to Andrews, et al.; U.S. Patent Application Publication No. 2009/39375 A1 to LeToquin, et al.; and U.S. Patent Application Publication No. 2009/0208269 A1 to Negley, et al. Each of the foregoing publications is hereby incorporated by reference herein.

In various embodiments as disclosed herein involving multiple lumiphors in conjunction with one or more solid state emitters, any one or both of the least one first lumiphor and the at least one second lumiphor may extend extends at least partially, or may extend fully, over one or more solid state emitter chips.

In certain embodiments, one or more wavelength conversion materials (lumiphors) are arranged within a single layer or dispersed within a unitary medium. In certain embodiments, one lumiphor is arranged in one lumiphor layer, and at least one other lumiphor is arranged in at least one other lumiphor layer. Such lumiphor layers may be arranged in contacting or non-contacting relationship. Lumiphor support elements or areas containing different lumiphors may be in non-overlapping, partially overlapping, or fully overlapping configurations relative to one another, depending on the embodiment.

In certain embodiments, a lumiphor-converted light emitting component may be in the form of a BSY emitter component including a blue emitter (e.g., InGaN-based LED) having a peak wavelength in a range of 400-480 nm (e.g., or optionally within one or more subranges of 430-470 nm, or 440-460 nm), and including a yellow lumiphor (e.g., including cerium-activated yttrium aluminum garnet (YAG:$Ce^{3+}$), BOSE, or $(Sr_{1.7}Ba_{0.2}Eu_{0.1})SiO_4$. having peak wavelength in a range of from 550-599 nm. In certain embodiments, the yellow lumiphor is contained within a coating or binding medium, and the coating or binding medium is arranged in contact with the foregoing (e.g., blue) solid state emitter. In certain embodiments, at least one spatially segregated lumiphor (i.e., segregated relative to the foregoing light emitting component) is preferably yellow-green or green in character, having a peak wavelength in a range of from 500-560 nm, more preferably 500-549 nm). Exemplary green or yellow-green lumiphors include $Lu_3Al_5O_{12}:Ce^{3+}$ (a/k/a LuAG: Ce3+); $(Ba,Sr)SiO_4:Eu^{2+}$, $(Lu_{0.9}Ce_{0.01})_3Al_5O_{13}$; $SrGa_2Se_4:Eu^{2+}$; and silicate-based green lumiphors as disclosed in U.S. Pat. No. 7,311,858 (which is hereby incorporated by reference herein) including phosphors having the formula $A_2SiO_4:Eu^2$+D, where A is at least one of a divalent metal selected from the group consisting of Sr, Ca, Ba, Mg, Zn, and Cd; and D is a dopant selected from the group consisting of F, Cl, Br, I, P, S and N. In certain embodiments, at least one spatially segregated lumiphor is primarily red in character, having a peak wavelength in a range of from 600-660 nm. Exemplary red lumiphors include $(Sr,Ba)_2Si_5N_8:Eu^{2+}$ and $(Sr,Ca)SiAlN_3:Eu^{2+}$. Exemplary red solid state emitters include AlInGaP-based red LEDs.

In certain embodiments, a lighting device includes an additional cyan or long wavelength blue solid state emitter (e.g., LED). Such emitter may have a peak wavelength in a range of from 481 to 499 nm. Presence of a cyan solid state emitter (which is preferably independently controllable) is desirable to permit adjustment or tuning of color temperature of the lighting device 330 (since the tie line for a solid state emitter having a ~487 nm peak wavelength is substantially parallel to the blackbody locus for a color temperature of less than 3000K to about 4000K). Each electrically activated emitter is preferably independently controllable, to permit output color and/or color temperature to be tuned. Multiple solid state light emitters (whether of substantially the same peak or dominant wavelength, or having peak wavelengths and/or dominant wavelengths differing by at least 10 nm) may be provided. Similarly, multiple lumiphors (e.g., having peak wavelengths and/or dominant wavelengths differing by at least 10 nm) may be provided.

Supplemental solid state emitters of any suitable colors (e.g., blue, green, yellow, amber, orange, red) may be provided, preferably in segregated relationship relative to at least one lumiphor support element. Such supplemental emitters may have associated therewith one or more lumiphors of any suitable peak wavelength. Lumiphors may be arranged to be stimulated by a single electrically activated solid state emitter or by multiple electrically activated solid state emitters.

In certain embodiments, multiple lumiphor-converted solid state emitter components (e.g., BSY components) as described herein may be provided. A first lumiphor-converted light emitting component may be arranged to stimulate emissions from a first spatially segregated supplemental lumiphor, and a second lumiphor-converted light emitting component may be arranged to stimulate emissions from a second spatially segregated supplemental lumiphor. In one embodiment, one supplemental lumiphor is adapted to emit a peak wavelength in a range of from 500 to 549 nm, and another supplemental lumiphor is adapted to emit a peak wavelength in a range of from 600 to 660 nm. The solid state emitter components may be independently controllable. A resulting device may include at least one of a lens, a diffuser, and a scattering material arranged to receive emissions from at least one first light emitting component and the second wavelength conversion material.

In certain embodiments, a solid state lighting device includes at least one of the following features that may be embodied with a solid state emitter package: a single leadframe arranged to conduct electrical power to solid state light emitters; a single reflector arranged to reflect at least a portion of light emanating from the solid state light emitters; a single submount supporting the solid state light emitters; and a single lens arranged to transmit at least a portion of light emanating from each of solid state light emitters.

In various embodiments as described herein, aggregated emissions from a lighting device produces a mixture of light having x, y coordinates on a 1931 CIE Chromaticity Diagram that define a first point within four MacAdam ellipses of a reference point on the BBL. In certain embodiments, such reference point may have a color temperature of less than or equal to 4000 K, or more preferably less than or equal to 3500K or even 3000K. In certain embodiments, combined emissions from a lighting device embody at least one of (a) a color rendering index (CRI Ra) value of at least 85, and (b) a color quality scale (CQS) value of at least 85.

In certain embodiments, at least one lumiphor-converted solid state emitter component includes emissions generated by at least one first solid state light emitter and at least one first wavelength conversion material produces a mixture of light having x, y coordinates on a 1931 CIE Chromaticity Diagram that define a first point within ten (more preferably within seven) MacAdam ellipses of at least one first reference point on the BBL. A second wavelength conversion material is spatially segregated from the foregoing light emitting component(s), arranged to receive emissions from the at least one first light emitting component and responsively convert (e.g., downconvert) a portion of the emissions from the at least one first light emitting component to generate second wavelength conversion material emissions. Further supplemental emissions are provided by at least one of (A) an electrically activated second solid state light emitter (e.g., adapted to emit a peak wavelength differing from (i) a peak wavelength of the at least one first solid state light emitter, (ii) a peak wavelength of the at least one first wavelength conversion material, and (iii) a peak wavelength of the second wavelength conversion material); and (B) a third wavelength conversion material spatially segregated from the at least one first light emitting component, arranged to receive emissions from the at least one first light emitting component and responsively convert (e.g., downconvert) a portion of the emissions from the at least one first light emitting component to generate third wavelength conversion material emissions including a peak wavelength differing from (i) a peak wavelength of the at least one first solid state light emitter, (ii) a peak wavelength of the at least one first wavelength conversion material, and (iii) a peak wavelength of the second wavelength conversion material. A combination of light exiting the lighting device produces a mixture of light having x, y coordinates on a 1931 CIE Chromaticity Diagram that define a second point within four MacAdam ellipses of at least one second reference point on the BBL. In certain embodiments, a color temperature of the above-mentioned first reference point is at least 1000 K (more preferably at least 1500 K) greater than a color temperature of the second reference point.

In certain embodiments, lighting device including a BSY light emitting component and a spatially segregated mixture of lumiphors is arranged to provide a CRI Ra of at least about 95, more preferably at least about 97, in combination with a luminous efficacy of at least about FIGS. 2A-2I illustrate examples of multi-chip solid state lamps each including a lumiphor-converted light emitting component (e.g., BSY emitter) arranged to stimulate a spatially segregated wavelength conversion material, and including at least one supplemental electrically activated solid state emitter and/or additional spatially segregated wavelength conversion material.

Figure 2A:
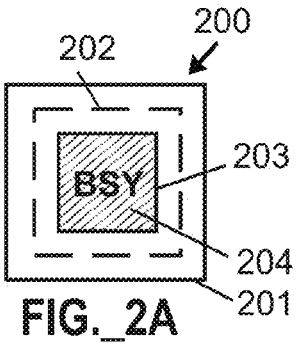
FIG. 2A is a top plan schematic view of a lighting device including a BSY solid state emitter overlaid with multiple wavelength conversion materials.

Referring to FIG. 2A, a LED lamp 200 includes substrate or submount 201 with a die mounting region 202 configured to accept a solid state emitter component 203 including an electrically activated solid state emitter chip and a wavelength conversion material arranged to receive emissions from the solid state emitter chip. Multiple wavelength conversion materials (e.g., lumiphors) 204 are spatially segregated from the solid state emitter component 203 (e.g., separated by at least one intermediate material and/or a gap), and are arranged to receive emissions from the solid state emitter component 203 and responsively emit peak wavelengths differing from peak wavelengths generated by the electrically activated solid state emitter chip and the wavelength conversion material of the solid state emitter component 203. In certain embodiments, the solid state emitter component 203 comprises a BSY emitter with an electrically activated solid state emitter chip adapted to emit a peak wavelength in a range of from 430 to 480 nm (including the blue spectral range), and with a first wavelength conversion material adapted to emit a peak wavelength in a range of from 550 to 599 nm (including the yellow spectral range). In certain embodiments, the wavelength conversion materials 204 include at least one wavelength conversion material adapted to emit a peak wavelength in a range of from 500 to 560 nm (including the green spectral range and overlapping a portion of the yellow spectral range), more preferably in a range of from 500 to 549 nm; and the wavelength conversion materials 204 include at least one wavelength conversion material adapted to emit a peak wavelength in a range of from 600 to 660 nm (including the red spectral range). The wavelength conversion materials 204 are preferably arranged to convert a portion of the emissions from the electrically activated solid state emitter chip to different wavelengths, and to allow transmission from the device 210 of a portion of the emissions from the electrically activated solid state emitter chip. Aggregated emissions from the lamp 200 preferably include at least four color peaks (i.e., having local peak wavelengths in wavelength ranges corresponding to at least four different colors of light, with such color peaks differing by at least 10 nm from one another) to provide white light as aggregated output. The resulting mixture of light preferably has x, y coordinates on a 1931 CIE Chromaticity Diagram that define a first point within four MacAdam ellipses of a reference point on the BBL, with the reference point having a color temperature of preferably less than 4000 K, and more preferably less than 3500 K. In certain embodiments, the reference color temperature is greater than 2000 K.

Figure 2B:
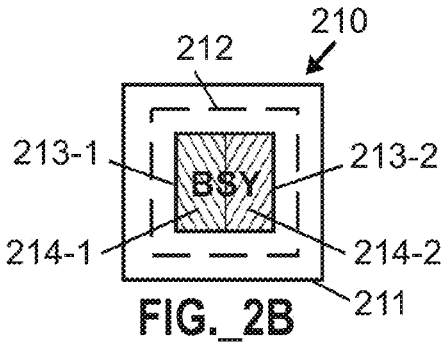
FIG. 2B is a top plan schematic view of a lighting device including a BSY solid state emitter arranged to stimulate wavelength conversion materials segregated laterally into first and second zones.

FIG. 2B illustrates another LED lamp 210 (similar to be lamp 200) including a substrate or submount 211 with a die mounting region 212 configured to accept a solid state emitter component 213 (inclusive of portions 213-1, 213-2) including an electrically activated solid state emitter chip and a wavelength conversion material arranged to receive emissions from the solid state emitter chip. First and second wavelength conversion materials (e.g., lumiphors) 214-1, 214-2 are each spatially segregated from the solid state emitter component 213 (e.g., separated by at least one intermediate material and/or a gap), and are arranged to receive emissions from the solid state emitter component 213 and responsively emit peak wavelengths differing from peak wavelengths generated by the electrically activated solid state emitter chip and the wavelength conversion material of the solid state emitter component 213. The wavelength conversion materials 214-1, 214-2 are arranged over different (e.g., discrete) regions of a lumiphor support element, with such regions preferably being substantially non-overlapping in character. Although only two discrete lumiphor regions 214-1, 214-2 are shown in FIG. 2B, it is to be appreciated that in various embodiments any desirable number of lumiphor regions may be provided in any desirable regular or irregular pattern overlying all or only portions of one or more solid state emitter chips (or one or more solid state emitter components including in combination a solid state emitter chip and a wavelength conversion material, such as a BSY emitter). An optional diffuser and/or scattering element (not shown) may be arranged between the lamp 210 and a light-emitting portion of a lighting device including the lamp 210. Aggregated emissions from the lamp 210 preferably include at least four color peaks to provide white light as aggregated output, with the resulting mixture of light having x, y coordinates within MacAdam ellipses of a reference point on the BBL (1931 CIE). In certain embodiments, the solid state emitter component 213 includes a solid state emitter chip adapted to emit a peak wavelength in a range of from 430 to 480 nm in combination with a first wavelength conversion material adapted to emit a peak wavelength in a range of from 550 to 599 nm; the first wavelength conversion material 214-1 is adapted to emit a peak wavelength in a range of from 500 to 560 nm (more preferably in a range of from 500 to 549 nm); and the second wavelength conversion material 214-2 is adapted to emit a peak wavelength in a range of from 600 to 660 nm.

In one embodiment, a lighting device according to FIG. 2B includes first and second solid state emitter components 213-1, 213-2 each including an electrically activated solid state emitter and a wavelength conversion material arranged to receive at least a portion of emissions from the solid state emitter and responsively emit light having a color peak differing from a color peak of the solid state emitter. Each solid state emitter component 213-1, 213-2 may be independently controlled, with the first component 213-1 being arranged to stimulate a first spatially separated wavelength conversion material 214-1, and with the second component 213-2 being arranged to stimulate a second spatially separated wavelength conversion material 214-2. By separately controlling the solid state emitter components 213-1, 213-2 (e.g., by independently controlling supply of electric current to each component), chromaticity and/or color temperature of aggregated emissions from the device 210 may be adjusted. Aggregated emissions from the lamp 200 preferably include at least four color peaks (i.e., having local peak wavelengths in wavelength ranges corresponding to at least four different colors of light) to provide white light as aggregated output. The resulting mixture of light preferably has x, y coordinates (1931 CIE) that define a first point within four MacAdam ellipses of a reference point on the BBL, with the reference point having a color temperature of preferably less than 4000 K, and more preferably less than 3500 K.

In one embodiment, as an alternative to presence of third and fourth wavelength conversion materials arranged to separately receive emissions from the first component 213-1 and the second component 213-1, different combinations (proportions) or mixtures of third and fourth wavelength materials may be arranged to separately receive emissions from the first component 213-1 and the second component 213-2. With reference to FIG. 2B, in such an embodiment, a first wavelength conversion material region 214-1 includes a first proportion or mixture of a first and a second wavelength conversion material, and a second wavelength conversion material region 214-2 includes a second proportion or mixture of a first and a second wavelength conversion material, wherein the first proportion or mixture differs from the second proportion or mixture with respect to amount or relative concentration of the first and second wavelength conversion materials.

Figure 2C:
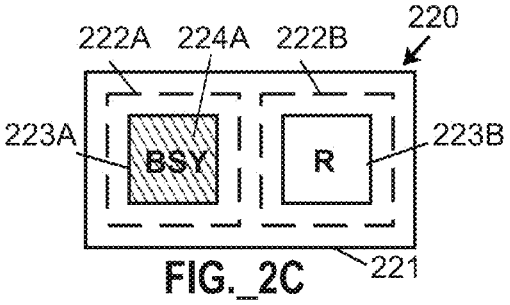
FIG. 2C is a top plan schematic view of a lighting device with two solid state emitters including a BSY solid state emitter arranged to stimulate at least one wavelength conversion material, and a red solid state emitter without a wavelength conversion material.

FIG. 2C illustrates a multi-chip solid state lamp 220 with a common (single) substrate or submount 221 that includes first and second die mounting regions 222A, 222B each configured to accept a solid state emitter chip (e.g., LED, an OLED, or laser diode). A first solid state emitter component 223A (including a first electrically activated solid state emitter chip and a wavelength conversion material arranged to receive emissions from the first solid state emitter chip) is mounted on the first die mounting region 222A, and a second solid state emitter component 223B is mounted on the second die mounting region 222B of the submount or substrate 221. In certain embodiments, the first solid state emitter component 223A includes a solid state emitter chip adapted to emit a peak wavelength in a range of from 430 to 480 nm in combination with a first wavelength conversion material adapted to emit a peak wavelength in a range of from 550 to 599 nm; the second wavelength conversion material 224A is adapted to emit a peak wavelength in a range of from 500 to 560 nm (more preferably in a range of from 500 to 549 nm), and the second solid state emitter 223B is adapted to emit a peak wavelength in a range of from 600 to 660 nm. Preferably, the first solid state emitter component 223A and the second solid state emitter 223B are independently controllable.

Figure 2G:
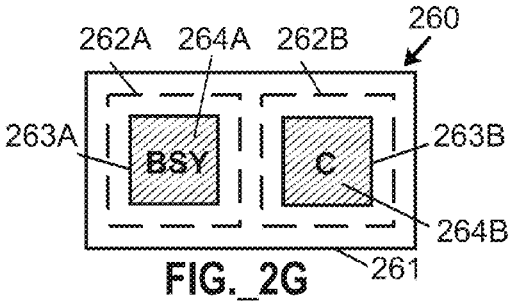
FIG. 2G is a top plan schematic view of a lighting device with two solid state emitters including a BSY solid state emitter arranged to stimulate at least one wavelength conversion material and a cyan solid state emitter overlaid with multiple wavelength conversion materials.
Figure 2D:
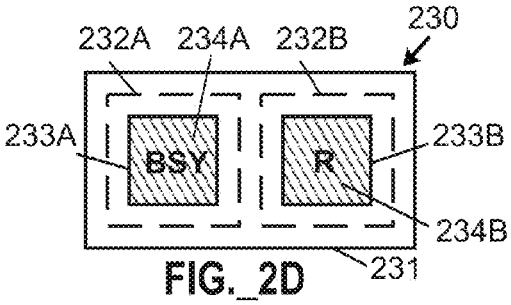
FIG. 2D is a top plan schematic view of a lighting device with two solid state emitters including a BSY solid state emitter arranged to stimulate at least one wavelength conversion material and a red solid state emitter overlaid with at least one wavelength conversion material.

FIG. 2D illustrates a multi-chip solid state lamp 230 with a common (single) substrate or submount 231 that includes first and second die mounting regions 232A, 232B each configured to accept a solid state emitter chip. A first solid state emitter component 233A (including a first electrically activated solid state emitter chip and a wavelength conversion material arranged to receive emissions from the first solid state emitter chip) is mounted on the first die mounting region 232A, and a second solid state emitter 233B is mounted on the second die mounting region 232B of the submount or substrate 231, with a second wavelength conversion material 234B arranged over the second solid state emitter chip 233B. The wavelength conversion materials 234A, 234B are preferably spatially segregated from the respective first solid state emitter component 233A and second solid state emitter chip 233B. The wavelength conversion material 234B over the second solid state emitter chip 233B may embody the same or different composition as the wavelength conversion material arranged over the first solid state emitter chip 233A, and although FIG. 2D illustrates the wavelength conversion materials 234A, 234B as being discontinuous, in certain embodiments such conversion materials 234A, 234B may be substantially continuous in character. In certain embodiments, the first solid state emitter component 233A includes a solid state emitter chip adapted to emit a peak wavelength in a range of from 430 to 480 nm in combination with a first wavelength conversion material adapted to emit a peak wavelength in a range of from 550 to 599 nm; the second wavelength conversion material 234A is adapted to emit a peak wavelength in a range of from 500 to 560 nm (more preferably in a range of from 500 to 549 nm), and the second solid state emitter 233B is adapted to emit a peak wavelength in a range of from 600 to 660 nm. In one embodiment, the wavelength conversion material 234B arranged over the second solid state emitter 233B is adapted to emit a peak wavelength in a range of from 500 to 560 nm (e.g., with the same composition as the second wavelength conversion material) 234A, and is arranged to be stimulated by emissions from the first solid state emitter (as part of component 233A) but not stimulated by emissions from the second solid state emitter 233B.

Figure 2H:
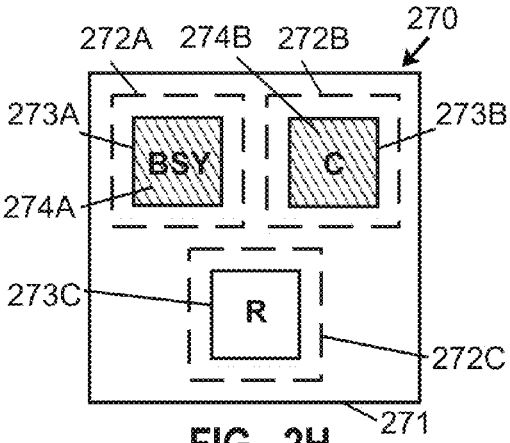
FIG. 2H is a top plan schematic view of a lighting device with three solid state emitters including a BSY solid state emitter arranged to stimulate at least one wavelength conversion material, a cyan solid state emitter overlaid with at least one wavelength conversion material, and a red solid state emitter without a wavelength conversion material.
Figure 2E:
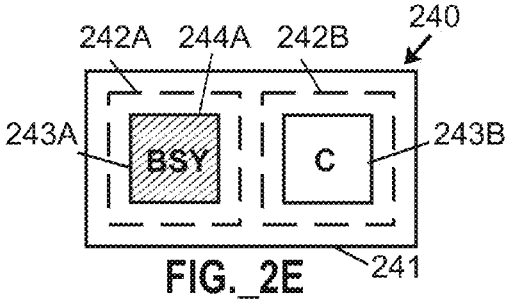
FIG. 2E is a top plan schematic view of a lighting device with two solid state emitters including a BSY solid state emitter arranged to stimulate at least one wavelength conversion material and a cyan solid state emitter without a wavelength conversion material.

FIG. 2E illustrates a multi-chip solid state lamp 240 with a common (single) substrate or submount 241 that includes first and second die mounting regions 242A, 242B each configured to accept a solid state emitter chip. A first solid state emitter component 243A (including a first electrically activated solid state emitter chip and a wavelength conversion material arranged to receive emissions from the first solid state emitter chip) is mounted on the first die mounting region 242A, and a second solid state emitter 243B is mounted on the second die mounting region 242B, with additional wavelength conversion materials 244B being spatially segregated from and arranged to receive emissions from the first solid state emitter component 243A. In certain embodiments, the first solid state emitter component 243A includes a solid state emitter chip adapted to emit a peak wavelength in a range of from 430 to 480 nm in combination with a first wavelength conversion material adapted to emit a peak wavelength in a range of from 550 to 599 nm; the wavelength conversion materials 244A are adapted to emit a peak wavelength in a range of from 500 to 560 nm (more preferably in a range of from 500 to 549 nm), and another peak wavelength in a range of from 600 to 660 nm; and the second solid state emitter 243B is adapted to emit a peak wavelength in a range of from 480-499 nm (i.e., including a long wavelength blue and/or cyan range).

Figure 2F:
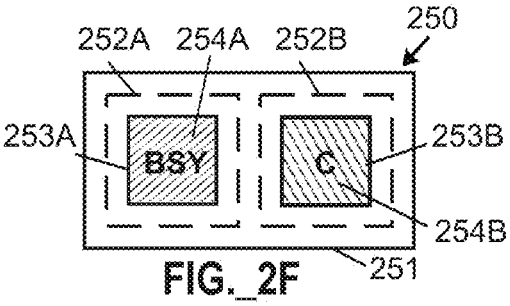
FIG. 2F is a top plan schematic view of a lighting device with two solid state emitters including a BSY solid state emitter arranged to stimulate at least one wavelength conversion material and a cyan solid state emitter overlaid with a wavelength conversion material.

FIG. 2F illustrates a multi-chip solid state lamp 250 similar to the lamp illustrated in FIG. 2E, but with at least one wavelength conversion material 254B arranged to receive emissions from the second solid state emitter 253B. The lamp 250 includes a common (single) substrate or submount 251 that includes first and second die mounting regions 252A, 252B each configured to accept a solid state emitter chip. A first solid state emitter component 253A (including a first electrically activated solid state emitter chip and a wavelength conversion material arranged to receive emissions from the first solid state emitter chip) is mounted on the first die mounting region 252A, and a second solid state emitter 253B is mounted on the second die mounting region 252B. One or more additional wavelength conversion materials 254A, 254B are spatially segregated from and arranged to receive emissions from the first component 253A and the second solid state emitter 253B, respectively. In certain embodiments, the first solid state emitter component 253A includes a solid state emitter chip adapted to emit a peak wavelength in a range of from 430 to 480 nm in combination with a first wavelength conversion material adapted to emit a peak wavelength in a range of from 550 to 599 nm; and the second solid state emitter 253B is adapted to emit a peak wavelength in a range of from 480-499 nm (i.e., including a long wavelength blue and/or cyan range). In certain embodiments, the solid state emitter component 253A and the second solid state emitter 253B are arranged to stimulate emissions from different wavelength conversion materials 254A, 254B, with one wavelength conversion material arranged to emit a peak wavelengths in a range of from 500 to 560 nm (more preferably in a range of from 500 to 549 nm) and another wavelength conversion material arranged to emit a peak wavelength in a range of from 600 to 660 nm. In certain embodiments, at least one of the wavelength conversion materials includes multiple wavelength conversion materials as mentioned above. In certain embodiments, different combinations (proportions) or mixtures of the wavelength materials may be arranged to separately receive emissions from the first component 253A and the second solid state emitter 253B.

FIG. 2G illustrates a multi-chip solid state lamp 250 similar to the lamp illustrated in FIG. 2F, but with multiple wavelength conversion materials arranged over each of the first solid state emitter component 263A and the second solid state emitter 263B. The lamp 260 includes a common (single) substrate or submount 261 that includes first and second die mounting regions 262A, 262B each configured to accept a solid state emitter chip (e.g., LED, an OLED, or laser diode). A first solid state emitter component 263A (including a first electrically activated solid state emitter chip and a wavelength conversion material arranged to receive emissions from the first solid state emitter chip) is mounted on the first die mounting region 262A, and a second solid state emitter 263B is mounted on the second die mounting region 262B. Multiple wavelength conversion materials are disposed each of the multiple wavelength conversion material regions 264A, 264B that are spatially segregated from and arranged to receive emissions from the first component 263A and the second solid state emitter 263B. The multiple wavelength conversion material regions may include the same or different proportions or amounts of wavelength conversion materials. In certain embodiments, the first solid state emitter component 263A includes a solid state emitter chip adapted to emit a peak wavelength in a range of from 430 to 480 nm in combination with a wavelength conversion material adapted to emit a peak wavelength in a range of from 550 to 599 nm; the second solid state emitter 263B is adapted to emit a peak wavelength in a range of from 480-499 nm (i.e., including a long wavelength blue and/or cyan range), and the wavelength conversion material regions each include one wavelength conversion material arranged to emit a peak wavelengths in a range of from 500 to 560 nm (more preferably in a range of from 500 to 549 nm) and another wavelength conversion material arranged to emit a peak wavelength in a range of from 600 to 660 nm. In certain embodiments, the first light emitting component 263A and the second light emitting chip 263A are independently controllable.

FIG. 2H illustrates a multi-chip solid state lamp 270 with a common (single) substrate or submount 271 that includes first, second, and third die mounting regions 272A, 272B, 272C each configured to accept a solid state emitter chip. A first solid state emitter component 273A (including a first electrically activated solid state emitter chip and a wavelength conversion material arranged to receive emissions from the first solid state emitter chip) is mounted on the first die mounting region 272A, and second and third solid state emitter chips 273B, 273C are mounted on the second and third die mounting regions 232B. 232C, respectively. At least one wavelength conversion material 274A is arranged to receive emissions from the first solid state emitter component 273A, and at least one wavelength conversion material 274B is arranged to receive emissions from the second solid state emitter component 273B, with the wavelength conversion materials 274A, 274B preferably being spatially segregated from the respective first solid state emitter component 273A and the second solid state emitter 273B. The at least one wavelength conversion material 274B over the second solid state emitter chip 273B may embody the same or different composition(s) as the at least one wavelength conversion material arranged over the first solid state emitter component 27A, and although FIG. 2H illustrates the wavelength conversion materials 274A, 274B as being discontinuous, in certain embodiments such conversion materials 274A, 274B may be substantially continuous in character (e.g., spanning a gap between the first emitter component 273A and second solid state emitter 273B. In certain embodiments, the first solid state emitter component 273A includes a solid state emitter chip adapted to emit a peak wavelength in a range of from 430 to 480 nm in combination with a first wavelength conversion material adapted to emit a peak wavelength in a range of from 550 to 599 nm; the at least one wavelength conversion material 274A arranged over the first solid state emitter component 273A is adapted to emit a peak wavelength in a range of from 500 to 560 nm (more preferably from 500 to 549 nm) (optionally including at least one wavelength conversion material 274A adapted to emit a peak wavelength in a range of from 600 to 660 nm). In certain embodiments, the second solid state emitter 273B is adapted to output a peak wavelength in a range of from 481 to 499 nm (corresponding to the long wavelength blue or cyan range), and at least one wavelength conversion material 274B arranged over the second solid state emitter 273B is adapted to emit a peak wavelength in a range of from 500 to 560 nm (more preferably from 500 to 549 nm) and/or a peak wavelength in a range of from 600 to 660 nm. In certain embodiments, the third solid state emitter 273C is adapted to emit a peak wavelength in a range of from 600 to 660 nm. Two or more, or all three, of the first solid state emitter component 273A, the second solid state emitter 273B, and the third solid state emitter 273C may be independently controlled.

Figure 2I:
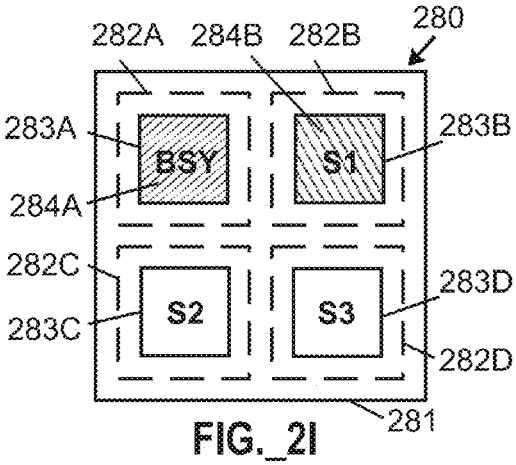
FIG. 2I is a top plan schematic view of a lighting device with two solid state emitters including a BSY solid state emitter arranged to stimulate at least one wavelength conversion material, a first supplemental solid state emitter arranged to stimulate at least one wavelength conversion material, and second and third supplemental solid state emitters without wavelength conversion materials.

FIG. 2I illustrates a multi-chip solid state lamp 280 with a common (single) substrate or submount 281 that includes first through fourth die mounting regions 282A-282D each configured to accept a solid state emitter chip. A first solid state emitter component 283A (including a first electrically activated solid state emitter chip and a wavelength conversion material arranged to receive emissions from the first solid state emitter chip) is mounted on the first die mounting region 282A, with respective second through fourth solid state emitters 283B-283D being mounted on the second through fourth die mounting regions 282B-282D. One or more additional wavelength conversion materials are spatially segregated from and arranged to receive emissions from the first solid state emitter component 283A and/or the second solid state emitter 283B. The third and fourth solid state emitters 283C, 283D may be devoid of wavelength conversion materials. In certain embodiments, the first solid state emitter component 283A includes a solid state emitter chip adapted to emit a peak wavelength in a range of from 430 to 480 nm in combination with a first wavelength conversion material adapted to emit a peak wavelength in a range of from 550 to 599 nm; the second solid state emitter 283B may be arranged to emit a peak wavelength in a range of from 430 to 499 nm; and the one or more wavelength conversion materials are adapted to emit a peak wavelength in a range of from 500 to 560 nm (more preferably from 500 to 549 nm) and/or a peak wavelength in a range of from 600 to 660 nm. The third and fourth solid state emitters 283C-283D may be arranged to peak wavelengths in any suitable ranges, such as (for example) in ranges of from 400-480 nm, 481-499 nm, 500-560 nm, or 600-660 nm. Two or more, all three, or all four of the first solid state emitter component 283A, and the second through fourth solid state emitters 283B-283D may be independently controlled.

Figure 3:
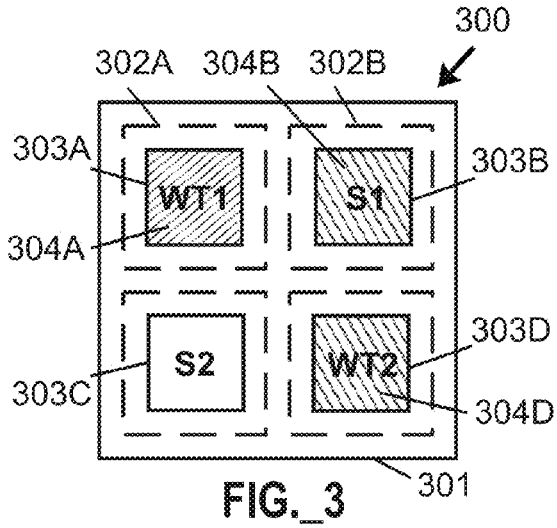
FIG. 3 is a top plan schematic view of a lighting device with four solid state emitters including a first white or near-white solid state emitter arranged to stimulate at least one wavelength conversion material, a second white or near-white solid state emitter arranged to stimulate at least one wavelength conversion material, a first supplemental solid state emitter arranged to stimulate at least one wavelength conversion material, and a second supplemental solid state emitter without a wavelength conversion material.

FIG. 3 illustrates a multi-chip solid state lamp 300 with a common (single) substrate or submount 301 that includes first through fourth die mounting regions 302A-302D each configured to accept a solid state emitter chip. First and second solid state emitter components 303A, 303D (mounted at die mounting regions 302A, 302D) each include an electrically activated solid state emitter chip and a wavelength conversion material arranged to receive emissions from the solid state emitter chip. Third and fourth solid state emitter chips 303B, 303C are mounted at die mounting regions 302B, 302C. One or more additional wavelength conversion materials are spatially segregated from and arranged to receive emissions from the first solid state emitter component 303A, the second solid state emitter component 303D, and/or the third solid state emitter chip 302B, and are arranged to be stimulated by emissions from at least one of the foregoing elements 303A, 303B, 303D. The fourth solid state emitters 303C may be devoid of wavelength conversion materials. In certain embodiments, the first solid state emitter component 303A and the second solid state emitter component 303D are each arranged to emit white or near-white light (e.g., within 7 MacAdam ellipses of the BBL (1931 CIE)). In one embodiment, each of the first and third solid state emitter components 303A, 303D include a solid state emitter chip adapted to emit a peak wavelength in a range of from 430 to 480 nm in combination with a wavelength conversion material adapted to emit a peak wavelength in a range of from 550 to 599 nm. One or more of the preceding solid state emitter and/or wavelength conversion material peak wavelengths may differ by at least about 10 nm between the first and the second solid state emitter components 303A, 303D. In certain embodiments, the second solid state emitter 303B may be arranged to emit a peak wavelength in a range of from 430 to 499 nm; and the one or more wavelength conversion materials 304A, 304B, 304D are adapted to emit a peak wavelength in a range of from 500 to 560 nm (more preferably from 500 to 549 nm) and/or a peak wavelength in a range of from 600 to 660 nm. The fourth solid state emitters 303C-303D may be arranged to peak wavelengths in any suitable ranges, such as (for example) in ranges of from 400-480 nm, 481-499 nm, 500-560 nm, or 600-660 nm. Two or more, all three, or all four of the solid state emitter components 303A, 303D and the solid state emitters 303B-303D may be independently controlled to adjust any of chromaticity, color temperature, and intensity of aggregate emissions from the lighting device. In certain embodiments, aggregated output of the lighting device 300 includes four, five, or six or more peak wavelengths (e.g., differing by at least 5 nm, or in some embodiments at least 10 nm, from one another).

Figure 4:
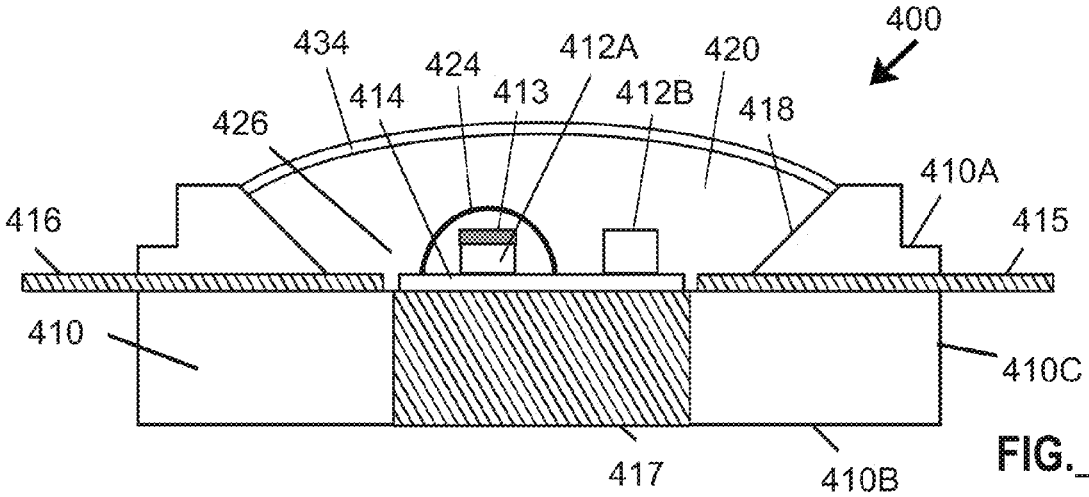
FIG. 4 a side cross-sectional view of at least a portion of a lighting device including multiple solid state emitters arranged in a solid state emitter package.

Various lighting devices as described herein may be embodied in, or may include, one or more solid state emitter packages. Referring to FIG. 4, an exemplary emitter package 400 may include multiple emitters 412A, 412B (e.g., LED chips manufactured by Cree, Inc., Durham, N.C.) with integral conductive substrates. Such solid emitters 412A, 412B may be vertical devices including anode and cathode contacts on opposing faces, respectively. The solid state emitters 412A, 412B may be mounted in a flip-chip configuration, with light emitting upward through substrates of the emitters 412A, 412B. Flip-chip mounting is not required; in other embodiments, solid state emitter chips may be mounted with substrate portions thereof proximate to a submount 414 or other supporting structure. At least the first solid state emitter 412A is arranged to interact with at least one lumiphor 413, which may be coated on or over the emitter 412A, with the combination of the emitter and lumiphor constituting a solid state emitter component. At least one additional lumiphor 424 may be spatially segregated from the first solid state emitter 412A. Wirebond connections (not shown) may connect external leads 415, 416 with conductive traces on the submount 414. The electrical leads 415, 416 may extend laterally outward past a side edge 410C of the body structure 410. The submount 414 and emitters 412A, 4128 are arranged in a reflector cup 418 positioned on an upper surface 410A of (or optionally integrated with) a package body structure 410. At least a portion of the reflector cup 418 may be filled with an encapsulant 420, which may be overlaid with at least one element 434 include one or more of a lens, diffuser, and/or additional lumiphoric material(s) spatially segregated from the emitters 412A, 412B. The body structure 410 preferably comprises an electrically insulating material such as a molded polymeric composition. Disposed within a central portion of the body 410 is a heatsink 417, which extends between the submount 414 and a lower surface 410B of the body 410. The heatsink 417 may be integrally formed with, or joined to, a leadframe. A similar solid state emitter package and fabrication details regarding same are provided in U.S. Pat. No. 7,655,957 to Loh, et al., which is incorporated by reference herein. As shown in FIG. 4, the package 400 includes multiple emitters 412A, 412B arranged over a single submount 414 and within a single reflector 418 which may be covered by a single lens (e.g., as may be associated with the encapsulant 420). Although only two solid state emitter chips 412A, 412B are shown in the package 400 according to FIG. 4, it is to be appreciated that any desirable number of solid state emitter chips may be provided in a single package and/or group of solid state emitter packages.

Various exemplary lighting devices including multiple solid state emitters (e.g., LED chips) and reflectors according to illustrative embodiments are illustrated and described in connection with FIGS. 5 and 7-12.

Figure 5:
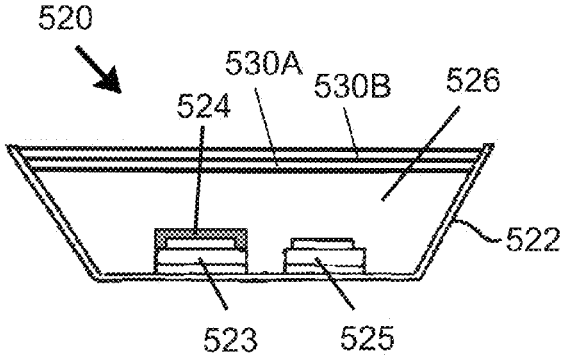
FIG. 5 is a side cross-sectional schematic view of a portion of a solid state lighting device including multiple solid state emitters and multiple wavelength conversion materials arranged in multiple layers spatially separated from the multiple solid state emitters.

In one embodiment, a solid state lighting device may include multiple solid state emitters and at least one lumiphor arranged in one or more layers spatially separated from the solid state emitters. FIG. 5 is a side cross-sectional schematic view of at least a portion of a solid state lighting device 520 including first and second solid state emitters (e.g., LEDs) 523, 525 mounted in, on, or over a reflector cup 522 or similar support structure, and one or more lumiphors 530A, 530B arranged in one or more layers that are spatially segregated from the LEDs 523, 525 and arranged between the LEDs 523, 525 and a light emitting end or surface of the lighting device 520. An encapsulant 526 and/or other material may be disposed between the LEDs 523, 525 and the lumiphors 530A, 530B; alternatively, the LEDs 523, 523 and lumiphors 530A, 530B may be separated by a gap. In one embodiment, the lumiphors 530A, 530B may be arranged in alternating layers, such as lumiphor support elements, that may be uniform or non-uniform in character. One advantage of confining different lumiphors to different layers is to avoid undue absorption of emission spectrum of one lumiphor that may overlap with excitation spectrum of another lumiphor (e.g., excitation spectrum of first phosphor (e.g., red) may overlap with emission spectrum of another phosphor, which would result in loss of efficiency). In one embodiment, lumiphor material may be dispersed in a non-uniform manner (e.g., patterned) within an individual lumiphor layer. In one embodiment, a lumiphor material layer may have a thickness that is non-uniform with respect to position. The solid state emitter 523 has associated therewith (e.g., coated thereon) a lumiphor 524, with such elements 523-524 constituting a solid state emitter component. In certain embodiments, the solid state emitter 523 is a primarily blue emitter having a peak wavelength in a range from 430 to 490 nm, and the lumiphor 524 has a peak wavelength in a range of from 550-599 nm, with the combination forming a BSY component. The other solid state emitter 525 may embody any suitable color, with or without an associated lumiphor. In certain embodiments, at least one lumiphoric material layers 530A, 530B may be adapted to emit a peak wavelength in a range of from 500 to 560 nm (more preferably from 500 to 549 nm) and a peak wavelength in a range of from 600 to 660 nm. Additional lumiphors and/or solid state emitters may be provided. The lumiphoric material layers 530A-530B may be uniform or non-uniform with respect to thickness, lumiphor concentration, lumiphor dispersion, and the like.

In certain embodiments, wavelength conversion materials (e.g., lumiphors) may be arranged in one or more patterned layers (e.g., including but not limited to stripes, checkerboards, polygonal geometric patterns, patterns involving curved shapes, dot patterns, and the like) overlying all or only portions of one or more solid state emitter chips. Lumiphors may be patterned on a lumiphor support element using any desirable patterning technique, such as may include inkjet printing, use of stencils or masks (such as may include use of photomasks), rollers, powder coating/curing, and the like. In different embodiments, a lumiphor support element may be patterned with lumiphors prior to addition to a LED lighting device, or a lumiphor support element may be patterned with lumiphors following addition to the LED lighting device.

Figure 6A:
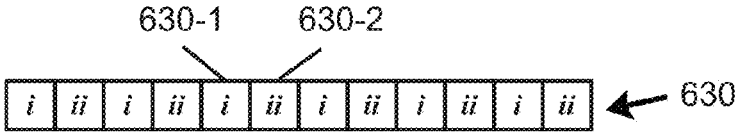
FIG. 6A is a side cross-sectional schematic view of a wavelength conversion material layer including different regions of first and second wavelength conversion materials arranged in pattern.
Figure 6B:
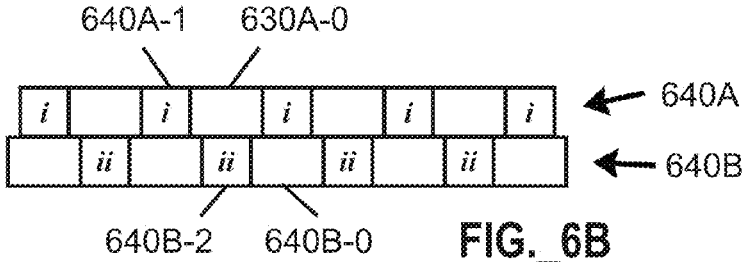
FIG. 6B is a side cross-sectional schematic view of two wavelength conversion material layers arranged in a contacting (stacked) relationship, with the first layer including regions of a first wavelength conversion material separated laterally by window regions, with the second layer including regions of a second wavelength conversion material separated laterally by window regions, and with the first wavelength conversion material regions arranged over window regions of the second layer.
Figure 6C:
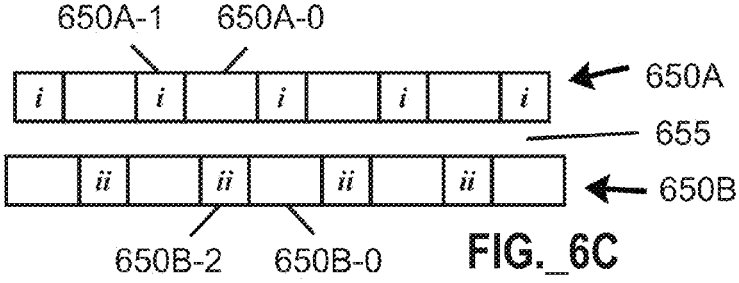
FIG. 6C is a side cross-sectional schematic view of two wavelength conversion material layers arranged in non-contacting relationship, with the first layer including regions of a first wavelength conversion material separated laterally by window regions, with the second layer including regions of a second wavelength conversion material separated laterally by window regions, and with the first wavelength conversion material regions arranged over window regions of the second layer.

Examples of different patterned layers and patterned layer combinations are illustrated in FIGS. 6A-6C. FIG. 6A illustrates a single wavelength conversion material layer 630 including different regions of first and second wavelength conversion materials 630-1, 630-2 arranged in an alternating pattern. FIG. 6B illustrates two wavelength conversion material layers 640A-640B arranged in a contacting (stacked) relationship, with the first layer 640A including regions of a first wavelength conversion material 640A-1 separated laterally by window regions 640A-0, with the second layer 640B including regions of a second wavelength conversion material 640B-2 separated laterally by window regions 640B-0. As illustrated, the first wavelength conversion material regions 640A-1 are aligned with window regions 640B-0 of the second layer 640B, and the second wavelength conversion material regions 640B-2 are aligned with window regions 640A-0 of the first layer 640A, such that regions of different wavelength conversion materials 640A-1, 640B-2 are not directly overlapping one another. FIG. 6C illustrates two wavelength conversion material layers 650A-650B arranged in non-contacting relationship separated by a gap 655 (or intervening material, not shown), with the first layer 650A including regions of a first wavelength conversion material 650A-1 separated laterally by window regions 650A-0, and with the second layer 650B including regions of a second wavelength conversion material 650B-2 separated laterally by window regions 650B-0. The first wavelength conversion material regions 650A-1 are aligned with window regions 650B-0 of the second layer 650B, and the second wavelength conversion material regions 650B-2 are aligned with window regions 650A-0 of the first layer 650A, such that regions of different wavelength conversion materials 650A-1, 650B-2 are not directly overlapping one another.

Figure 7:
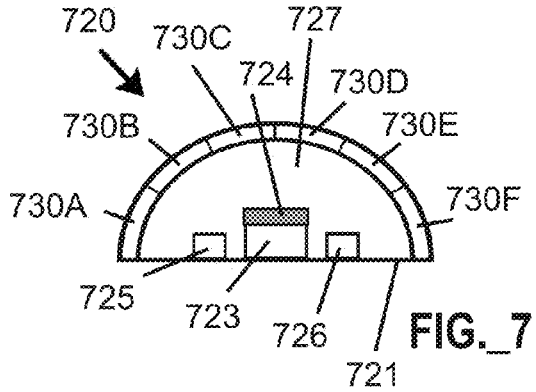
FIG. 7 is a side cross-sectional schematic view of a portion of a solid state lighting device including multiple solid state emitters and multiple wavelength conversion materials patterned in different regions spatially separated from the multiple solid state emitters.

FIG. 7 illustrates a solid state lighting device 720 including multiple solid state emitters 723, 725, 726 (with one emitter 723 having an associated lumiphoric material 724 arranged thereon) supported by a substrate 721, and multiple wavelength conversion materials patterned in different regions 730A-730F of at least one layer spatially separated from the multiple solid state emitters 723, 725, 726. The solid state emitters 723, 725, 726 may be separated from the wavelength conversion materials 730A-730F by an intervening material 727 (e.g., encapsulant material) or an air gap. Any suitable number of wavelength conversion materials may be provided. In one embodiment, the emitter 723 having an associated lumiphoric material 724 constitute a BSY emitter component, and the wavelength conversion materials 730A-730E are adapted to emit a peak wavelength in a range of from 500 to 560 nm (more preferably from 500 to 549 nm) and/or a peak wavelength in a range of from 600 to 660 nm. The additional solid state emitters 725-726 may be adapted to output any desirable peak wavelengths, such as (for example) in ranges of from 400-480 nm, 481-499 nm, 500-560 nm, or 600-660 nm. Additional lumiphors and/or solid state emitters may be provided. In certain embodiments, at least two or all of the solid state emitters 723, 725, 726 may be independently controlled.

Figure 8:
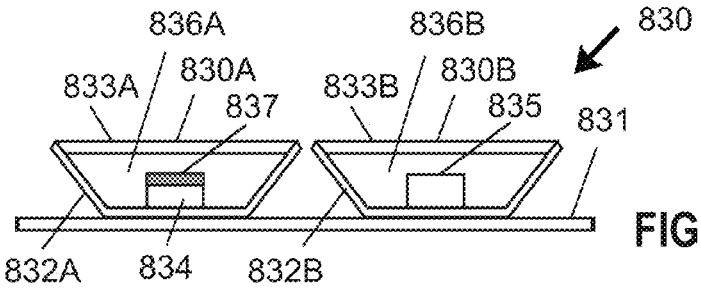
FIG. 8 is a side cross-sectional schematic view of a portion of a solid state lighting device including solid state emitters arranged in different reflectors supported by a common substrate, and illustrating at least one wavelength being spatially separated from each solid state emitter.

In certain embodiments, different solid state emitters may be arranged in, on, or over different reflectors disposed over a common (single) submount or other structural support element of a lighting device. FIG. 8 is a side cross-sectional schematic view of at least a portion of a solid state lighting device 830 including a first solid state emitter (e.g., first LED) 834 mounted in or on a first reflector 832A, and including a second solid state emitter (e.g., second LED) 835 mounted in or on a second reflector 832B, with each reflector 832A, 832B arranged on or over a single submount 801 or other support structure. A lumiphoric material 837 is arranged on the first solid state emitter 834, with the combination of such elements constituting a light emitting component (for example, a BSY component). Each solid state emitter 834, 835 may be covered with an encapsulant material 836A, 836B, and may have at least one spatially separated lumiphor and/or optical element 833A, 833B arranged between the respective solid state emitters 834, 835 and light emitting end portions or surfaces 830A, 830B of the lighting device 830. In certain embodiments, the first solid state emitter 834 in combination with the first lumiphor 837 comprises a BSY component, the other solid state emitter 835 comprises a red (e.g., peak wavelength in a range of from 600-660 nm) or cyan/long wavelength blue (e.g., peak wavelength in a range of from 481-499 nm) solid state emitter, element 833A includes a yellow-green lumiphor (e.g., peak wavelength in a range of from 500-560 nm, or from 500-549 nm) optionally combined with a red lumiphor (e.g., peak wavelength in a range of from 600-660 nm), arranged to be stimulated by the blue emitter 834. If the solid state emitter 835 comprises a cyan solid state emitter, then the element 833B may include at least one lumiphor arranged to be stimulated by such emitter 835. Each solid state emitter 834-835 may be independently controlled. Additional lumiphors and/or solid state emitters may be provided.

Figure 9:
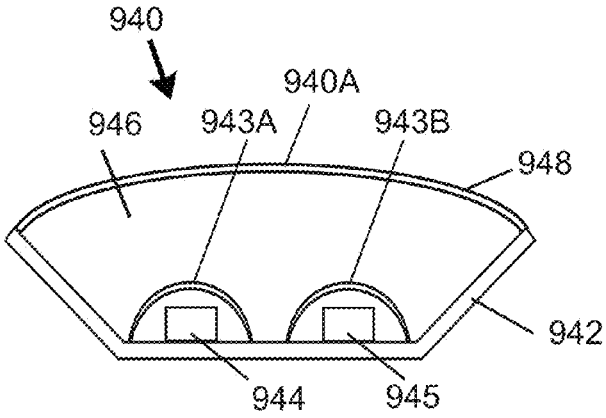
FIG. 9 is a side cross-sectional schematic view of a portion of a solid state lighting device including solid state light emitters arranged within a recess of a single reflector.

In certain embodiments, lumiphors may be arranged in non-contacting relationship over different solid state emitters of a solid state lighting device. Referring to FIG. 9, a solid state lighting device 940 includes first and second solid state emitters (e.g., LED chips) 944, 945 supported in, on, or over a reflector cup 942 or other support structure, with at least one different lumiphor 943A, 943B arranged in non-contacting relationship over each solid state emitter 944, 945. The amount, concentration, and/or thickness of each lumiphor 943A, 943B may be the same or different as compared to one another, and any one or more of lumiphor amount, concentration, and/or thickness may vary spatially with respect to each individual solid state emitter 944, 945. Encapsulant material 946, and optical elements and/or additional lumiphors(s) 948, may be arranged between the solid state emitters 944, 945 and a light emitting end or surface 940 of the lighting device 940. In certain embodiments, a first solid state emitter 944 comprises a blue LED, a second solid state emitter 945 comprises a cyan LED, a first lumiphor 943A includes a yellow phosphor arranged to be stimulated by the blue LED 944 (with the emitter 944 and lumiphor 943 representing a BSY emitter), the second lumiphor 943B has a peak wavelength in the red range (e.g., 660-660 nm) and/or yellow-green range (e.g., 500-560 nm, more preferably 500-549 nm), and the further lumiphor(s) 948 are in the red, yellow-green, and/or cyan range(s). In certain embodiments, the second emitter-lumiphor combination may be replaced with a red solid state emitter or a blue solid state emitter arranged to stimulate emissions from a red lumiphor. Additional and/or different lumiphors and solid state emitters may be provided.

Although only two solid state emitters are illustrated in each of FIGS. 5, 8, and 9, it is to be appreciated that any desirable number of solid state emitters may be provided in a single device, and/or additional lumiphors may be provided. Additional components such as diffusers, light scattering layers, lenses, and the like may be provided with solid state lighting devices as disclosed herein to affect direction, diffusion, focusing, or other properties of emissions generated by a lighting device.

Figure 10:
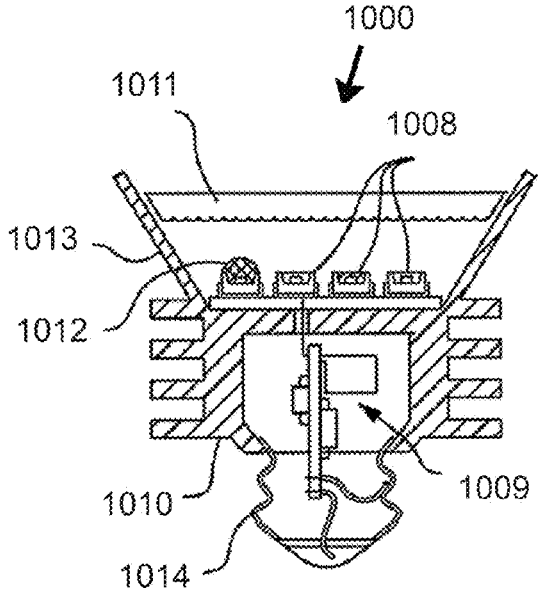
FIG. 10 is a cross-sectional side view of a self-ballasted lamp including multiple solid state emitters.

FIG. 10 is a cross-sectional side view of a self-ballasted lamp (lighting device) including multiple solid state emitters. The lighting device 1000 includes solid state emitters (e.g., LEDs) 1008, a power supply unit and controller 1009, a heat sink 1010, a diffuser 1011 or other optical element optionally supporting at least one lumiphor, a light and/or color sensor 1012, a reflector 1013, and a power connector 1014. Such a device may include at least one lumiphor converted solid state emitter component (e.g., a BSY component) and at least one lumiphor spatially separated therefrom. Further details regarding self-ballasted lamps are disclosed in U.S. Patent Application Publication No. 2008/0130298, which is hereby incorporated by reference.

Figure 11:
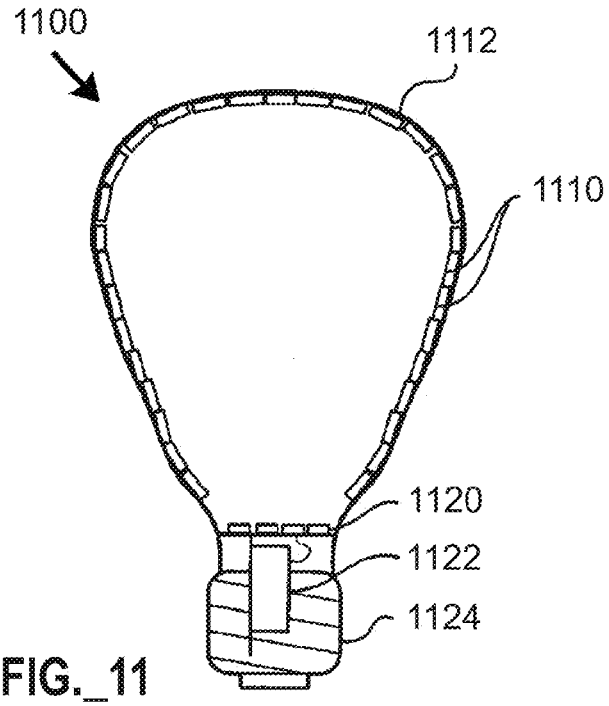
FIG. 11 is a cross-sectional side view of another self-ballasted lamp including multiple solid state emitters and discrete regions of wavelength conversion material arranged in or on a cover or globe portion of the lamp.

FIG. 11 is a cross-sectional side view of another self-ballasted lamp 1100 (e.g., classified under the UL 1993 safety standard) including multiple solid state emitters 1120 (of which one is arranged as a lumiphor-converted component, such as a BSY component) and discrete regions of wavelength conversion material 1110 arranged in or on a cover or globe portion 1112 of the lamp 1100, with the cover or globe portion 1112 being arranged remotely (spatially segregated) from the solid state emitters 1120. The lamp 1100 also includes a power supply 1122 and a connector 1124. The connector 1124 is illustrated as an Edison screw-base, however, other connector types, such as a pin base or GU-24 base, could also be utilized. While the lamp 800 is illustrated as an A-lamp, other lamp configurations may be provided, such as a PAR or BR lamp or non-standard lamp configurations.

Figure 12:
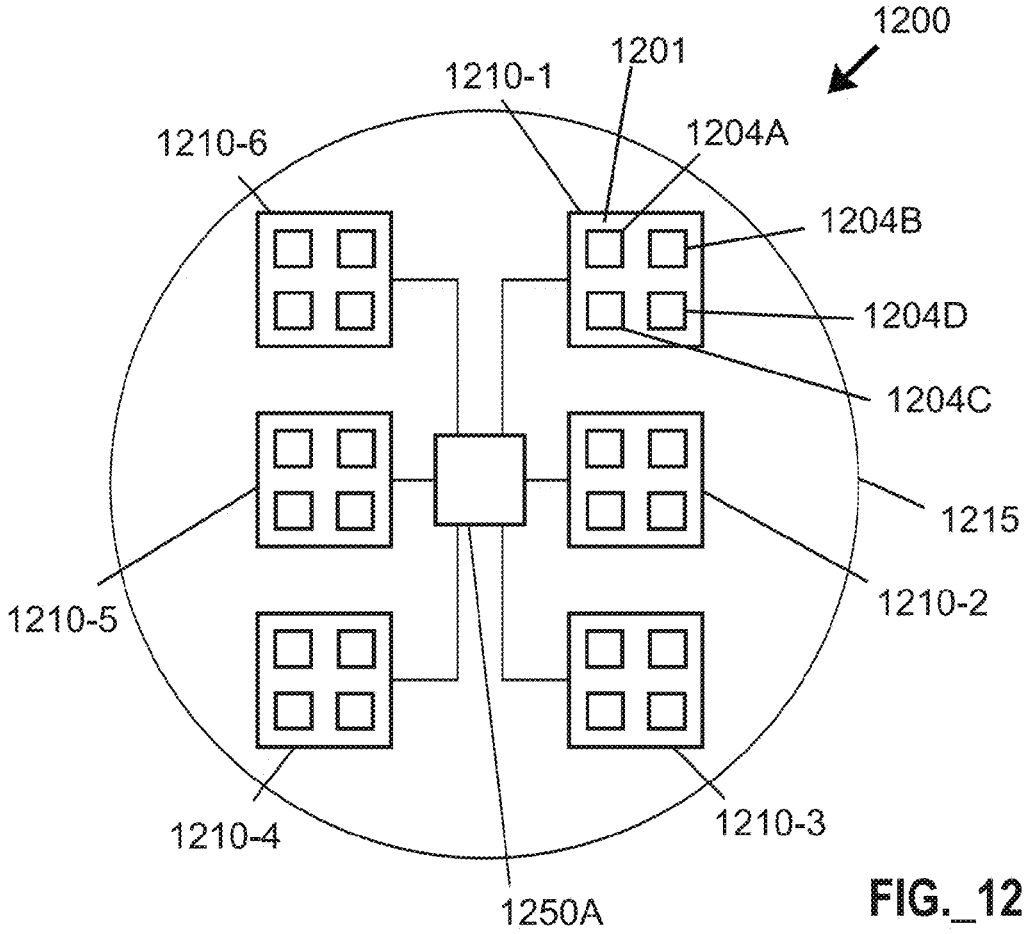
FIG. 12 is a schematic view of a lighting device including multiple emitters controllable by a control circuit.

FIG. 12 illustrates a light fixture 1200 according to at least one embodiment of the present invention. The light fixture 1200 includes a mounting plate 1215 to which multiple solid state emitter (e.g., LED) lamps 1210-1 to 1210-6 (with at least some lamps 1210-1 to 1210-6 optionally embodying a multi-chip lamp) are attached. Although the mounting plate 1215 is illustrated as having a circular shape, the mounting plate may be provided in any suitable shape or configuration (including non-planar and curvilinear configurations). As used herein, the term "multi-chip solid state lamp" refers to a lamp including at least two solid state emitter chips (e.g., LED chips). Different solid state emitter chips within a single multi-chip solid state emitter lamp may be configured to emit the same or different colors (e.g., wavelengths) of light. With specific reference to the first solid state lamp 1210-1, each solid state lamp 1210-1 to 1210-6 may include multiple solid state emitters (e.g., LEDs) 1204A-1204C preferably arranged on a single submount 1201. Although FIG. 12 illustrates four solid state emitter chips as being associated with each multi-chip solid state lamp 1210-1 to 1210-6, it is to be appreciated that any suitable number of solid state emitter chips may be associated with each multi-chip solid state lamp 1210-1 to 1210-6, and the number of solid state emitter chips associated with different (e.g., multi-chip) solid state lamps may be different. Each solid state lamp in a single fixture 1200 may be substantially identical to one another, or solid state lamps with different output characteristics may be intentionally provided in a single fixture 1200.

The solid state lamps 1210-1 to 1210-6 may be grouped on the mounting plate 1215 in clusters or other arrangements so that the light fixture 1200 outputs a desired pattern of light. In certain embodiments, at least one state emitter lamp associated with a single fixture 1200 includes a lumiphor-converted light emitting component (e.g., BSY emitter) arranged to stimulate a spatially segregated wavelength conversion material, and includes at least one supplemental electrically activated solid state emitter and/or additional spatially segregated wavelength conversion material. Such lamp may be devoid of emitters arranged to emit other wavelengths, or may be supplemented with one or more additional solid state emitters and/or wavelength conversion materials arranged to emit light with peak wavelengths other than those provided by the foregoing solid state emitters and wavelength conversion materials. In one embodiment, one or more of the multi-chip solid state lamps is configured to emit light having a spectral distribution including at least four color peaks (i.e., having local peak wavelengths in wavelength ranges corresponding to at least four different colors of light) to provide white light as aggregated output. Various other combinations of solid state emitters and wavelength conversion materials may be embodied in lamps, such as (but not limited to), the combinations illustrated and described in connection with FIGS. 2A-2I 3, 4, and 6-9.

With continued reference to FIG. 12, the light fixture 1200 includes a control circuit 1250A that is configured to operate the lamps 1210-1 to 1210-6 by independently applying drive currents to one at least one individual electrically activated solid state light emitting chip 1204A-1204D associated with each lamp 1210-1 to 1210-6. Where multiple solid state chips are provided in each lamp, each solid state chip 1204A-1204D in each lamp 1210-1 to 1210-6 may be configured to be individually addressed by the control circuit 1250A. In one embodiment, the control circuit 1250A may include a current supply circuit configured to independently apply an on-state drive current to each individual solid state chip responsive to a control signal, and may include one or more control elements configured to selectively provide control signals to the current supply circuit. As solid state emitters (e.g., LEDs) are current-controlled devices, the intensity of the light emitted from an electrically activated solid state emitter (e.g., LED) is related to the amount of current with which the device is driven. A common method for controlling the current driven through an LED to achieve desired intensity and/or color mixing is a Pulse Width Modulation (PWM) scheme, which alternately pulses the LEDs to a full current "ON" state followed by a zero current "OFF" state. The control circuit 1250A may be configured to control the current driven through the solid state emitter chips 1204A-604D associated with the lamps 1210-1 to 1210-6 using one or more control schemes known in the art. The control circuit 1250A may be attached to an opposite or back surface of the mounting plate 1215, or may be provided in an enclosure or other structure (not shown) that is segregated from the lighting device 1200.

While not illustrated in FIG. 12, the light fixture 1200 a may further include one or more heat spreading components and/or heatsinks for spreading and/or removing heat emitted by solid state emitter chips 1204A-1204D associated with the lamps 1210-1 to 1210-6. For example, a heat spreading component may include a sheet of thermally conductive material configured to conduct heat generated by the solid state emitter chips 1204A-1204D of the light fixture 1200 and spread the conducted heat over the area of the mounting plate 1205 to reduce thermal stratification in the light fixture 1200. A heat spreading component may be embodied in a solid material, a honeycomb or other mesh material, an anisotropic thermally conductive material (e.g., graphite), and/or other materials or configurations.

FIGS. 13A-13C embody first, second, and third portions of a table including results of a simulation of a light emitting component including at least one blue LED (452 nm peak wavelength) overlaid with a YAG phosphor (represented as "Y108" in FIGS. 13A-13C), and arranged to stimulate a remote (i.e., spatially separated) mixture of a LuAG green phosphor (543 nm peak wavelength) and a CASN red phosphor (640 nm peak wavelength), yielding CRI Ra of 97 and luminous efficacy of about 60 lumens per watt at a color temperature of approximately 3000K. The first and second rows of FIGS. 13A-13C corresponds to the YAG phosphor and the CASN red phosphor, with the third row corresponding to the LED and red phosphor combination, the fourth row corresponding to the LuAG green phosphor, and the fifth row corresponding to a blue LED and yellow (YAG) phosphor combination. In FIG. 13A, the third through sixth columns provide values for color coordinates x,y and x',y', respectively, and the seventh through tenth columns provide values for dominant wavelength, peak wavelength, comp, and purity, respectively. In FIG. 13B, the third through tenth columns provide values for correlative color temperature (CCT), full width half maximum (FWHM), radiant intensity per part (mW/part), lumens per part (L/prt), forward voltage, forward current, power, and luminous efficacy (l/w), respectively. In FIG. 13C, the third through sixth columns provide values for, radiant intensity (mW), radiant intensity percentage (mW %), lumens (L), and lumen percentage (L %), respectively, while the eighth through eleventh columns provide values for power (W), LEP luminous efficacy (lumens/watt optical), and wall plug efficiency (representing a ratio of optical visible and electrical power), and bin, respectively.

FIG. 14A provides tabulated results for LED output, and FIG. 14B provides tabulated results for fixture output, for the simulation of FIGS. 13A-13C.

FIG. 15A is a pie chart providing relative lumen outputs (in percent) for red (1), green (2), and blue (3) fractions of the simulation of FIGS. 13A-13C. FIG. 15B is a pie chart providing relative radiant intensity (in percent) allocated to red (1), green (2), and blue (3) fractions of the simulation of FIGS. 13A-13C.

Figure 16:
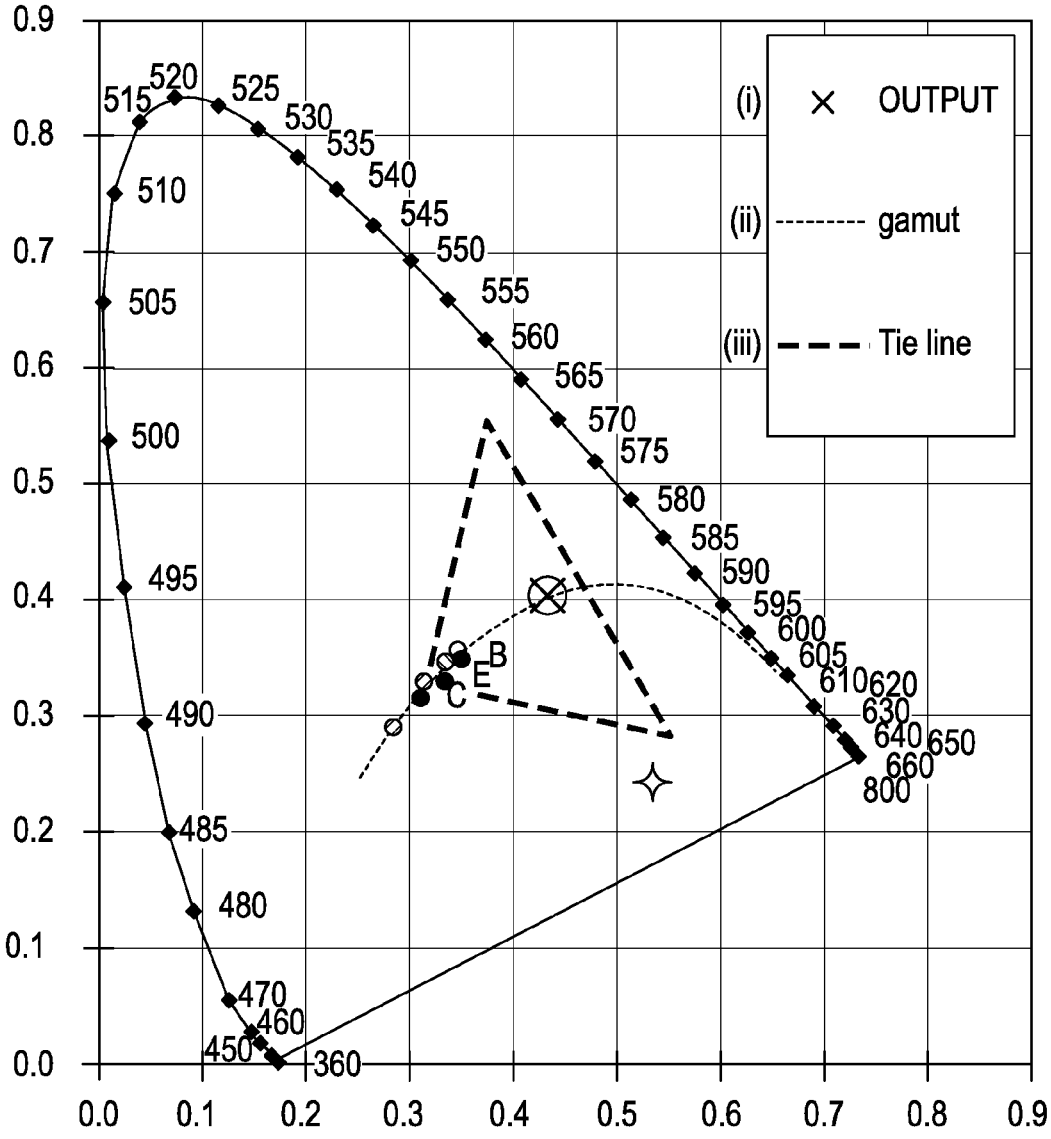
FIG. 16 is a 1931 CIE Chromaticity Diagram over which results of the simulation of FIGS. 13A-13C have been superimposed.

FIG. 16 is a 1931 CIE Chromaticity Diagram over which output of the simulation described in connection with FIGS. 13A-13C (at a CCT of 3000 K) have been superimposed. In such figure: item (i) represents the output color point; item (ii) illustrates the gamut of the sRGB color space (border lines in curved triangular shape labeled with wavelengths); and item (iii) represents tie lines for the respective emitting components. The curved line extending from the rightmost corner of the substantially triangular gamut of the sRGB color space into the interior thereof represents the blackbody locus.

Figure 17:
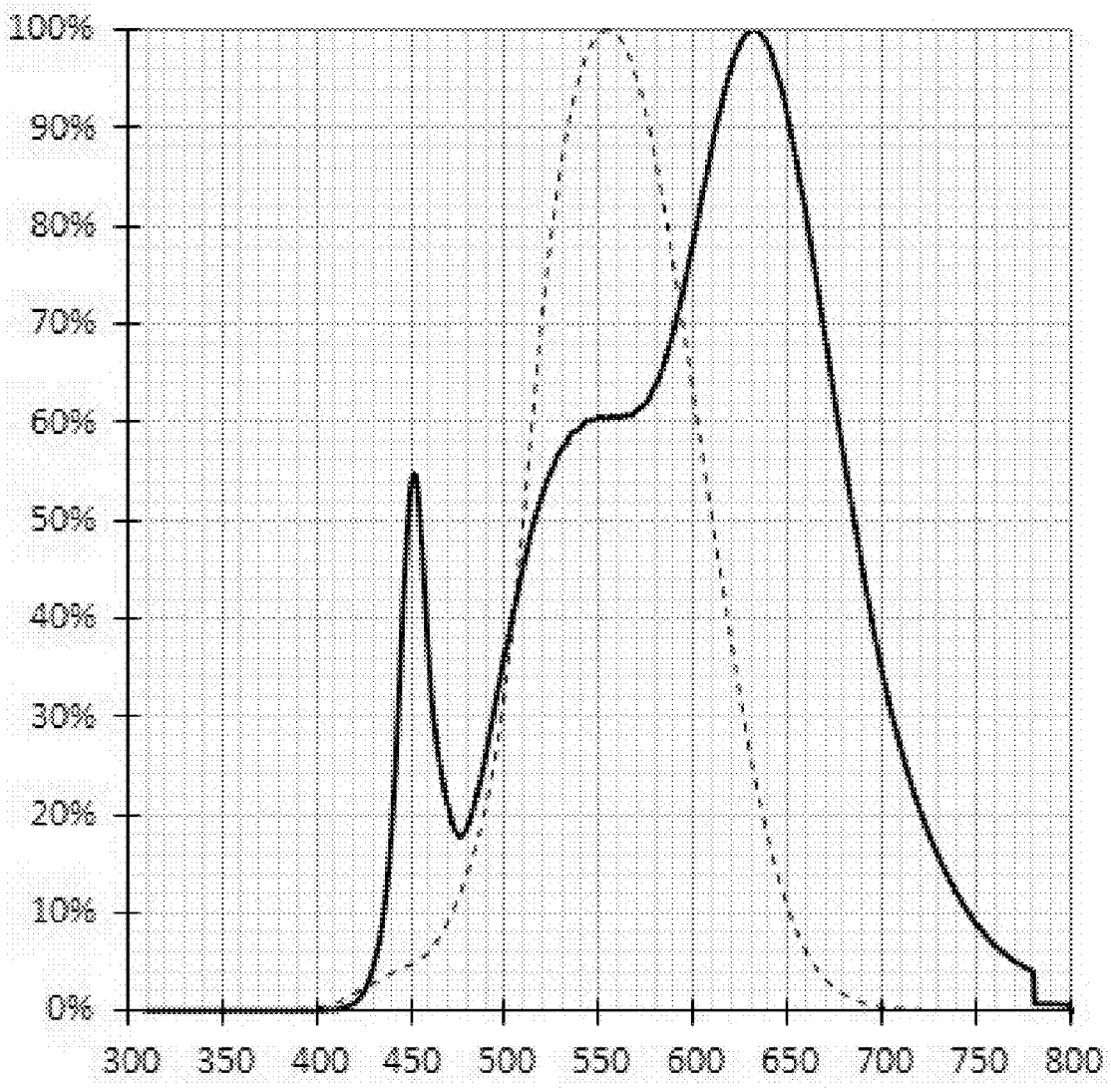
FIG. 17 is a plot of relative spectral power (percent) versus wavelength resulting from the simulation of FIGS. 13A-13C.

FIG. 17 is a plot of relative spectral power (percent) versus wavelength resulting from the simulation of FIGS. 13A-13C.

Figure 18A:
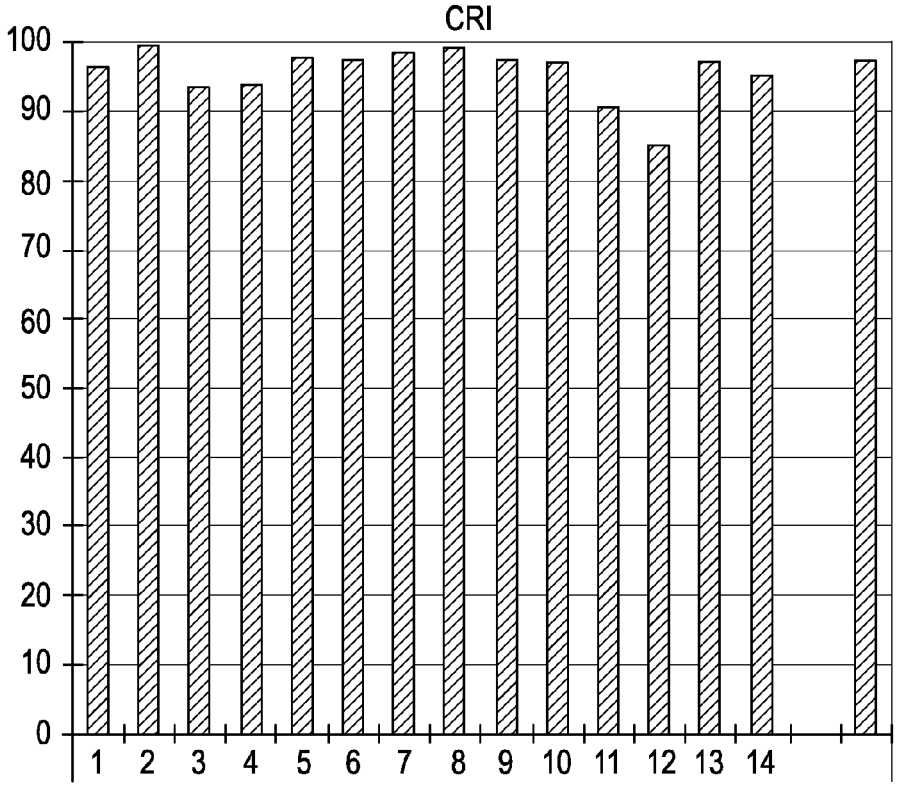
FIG. 18A is a bar chart embodying Color Rendering Index (CRI) performance for the simulation of FIGS. 13A-13C.
Figure 18B:
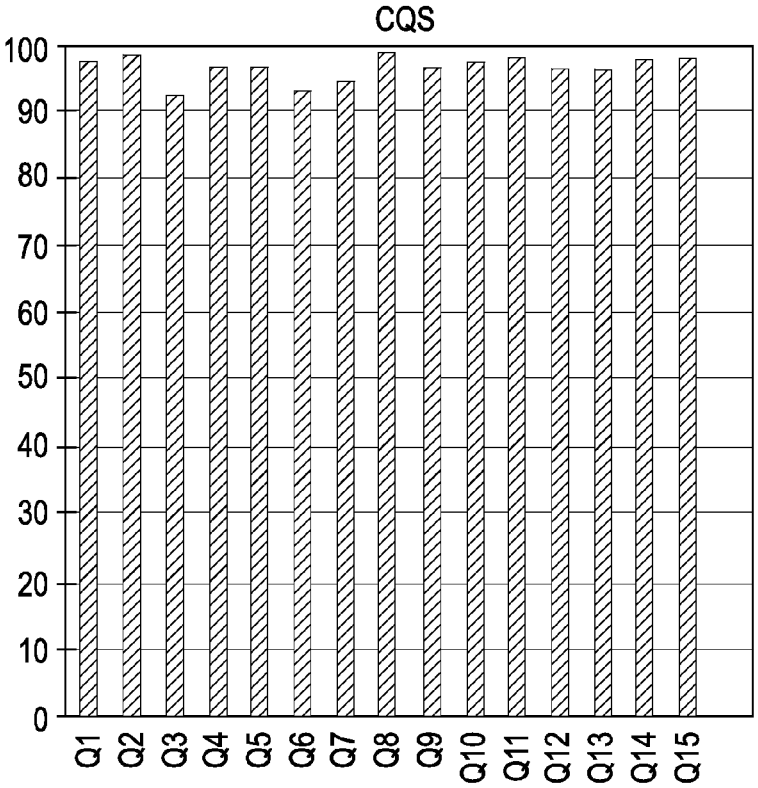
FIG. 18B is a bar chart embodying Color Quality Scale (CQS) performance for the simulation of FIGS. 13A-13C.

FIG. 18A is a bar chart embodying Color Rendering Index (CRI) performance for the simulation of FIGS. 13A-13C. The rightmost bar of FIG. 18A embodies CRI Ra, with a value greater than 97. FIG. 18B is a bar chart embodying Color Quality Scale (CQS) performance for the simulation of FIGS. 13A-13C. As shown in FIG. 18B, all values for Q1 through Q15 are greater than 90.

FIGS. 19A-19C embody first, second, and third portions of a table including results of a simulation of a light emitting component including at least one blue LED (452 nm peak wavelength) overlaid with a YAG phosphor (represented as "Y108" in FIGS. 19A-19C), and arranged to stimulate a remote (i.e., spatially separated) LuAG green phosphor (543 nm peak wavelength), in combination with an AlInGaP-based red LED, at a color temperature of approximately 4000K, yielding CRI Ra of greater than 85 and improved luminous efficacy relative to the simulation of FIGS. 13A-13C. The first and second rows of FIGS. 19A-19C corresponds to the YAG phosphor and the LuAG green phosphor, with the third row corresponding to the red LED, the fourth row corresponding to the LuAG green phosphor, and the fifth row corresponding to the yellow (YAG) phosphor. In FIG. 19A, the third through sixth columns provide values for color coordinates x,y and x',y', respectively, and the seventh through tenth columns provide values for dominant wavelength, peak wavelength, comp, and purity, respectively. In FIG. 19B, the third through tenth columns provide values for correlative color temperature (CCT), full width half maximum (FWHM), radiant intensity per part (mW/part), lumens per part (L/prt), forward voltage, forward current, power, and luminous efficacy (l/w), respectively. In FIG. 19C, the third through sixth columns provide values for, radiant intensity (mW), radiant intensity percentage (mW %), lumens (L), and lumen percentage (L %), respectively, while the eighth through eleventh columns provide values for power (W), LEP luminous efficacy (lumens/watt optical), and wall plug efficiency (representing a ratio of optical visible and electrical power), and bin, respectively.

FIG. 20A provides tabulated results for LED output, and FIG. 20B provides tabulated results for fixture output, for the simulation of FIGS. 19A-19C.

FIG. 21A is a pie chart providing relative lumen outputs (in percent) for red (1), green (2), and blue (3) fractions of the simulation of FIGS. 19A-19C. FIG. 21B is a pie chart providing relative radiant intensity (in percent) allocated to red (1), green (2), and blue (3) fractions of the simulation of FIGS. 19A-19C.

Figure 22:
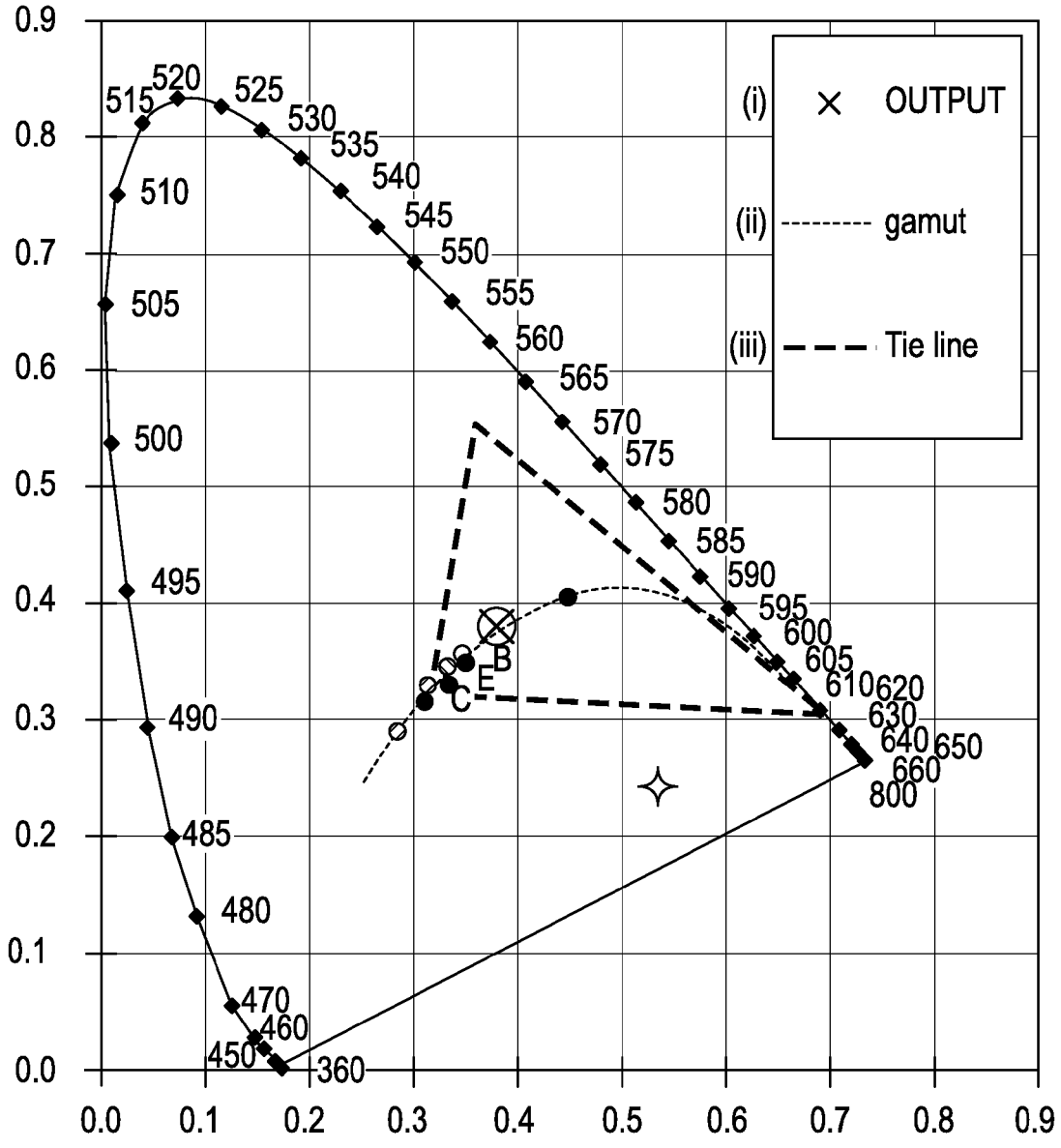
FIG. 22 is a 1931 CIE Chromaticity Diagram over which results of the simulation of FIGS. 19A-19C have been superimposed.

FIG. 22 is a 1931 CIE Chromaticity Diagram over which output of the simulation described in connection with FIGS. 19A-19C (at a CCT of 4000 K) have been superimposed. In such figure: item (i) represents the output color point; item (ii) illustrates the gamut of the sRGB color space (border lines in curved triangular shape labeled with wavelengths); and item (iii) represents tie lines for the respective emitting components. The curved line extending from the rightmost corner of the substantially triangular gamut of the sRGB color space into the interior thereof represents the blackbody locus.

Figure 23:
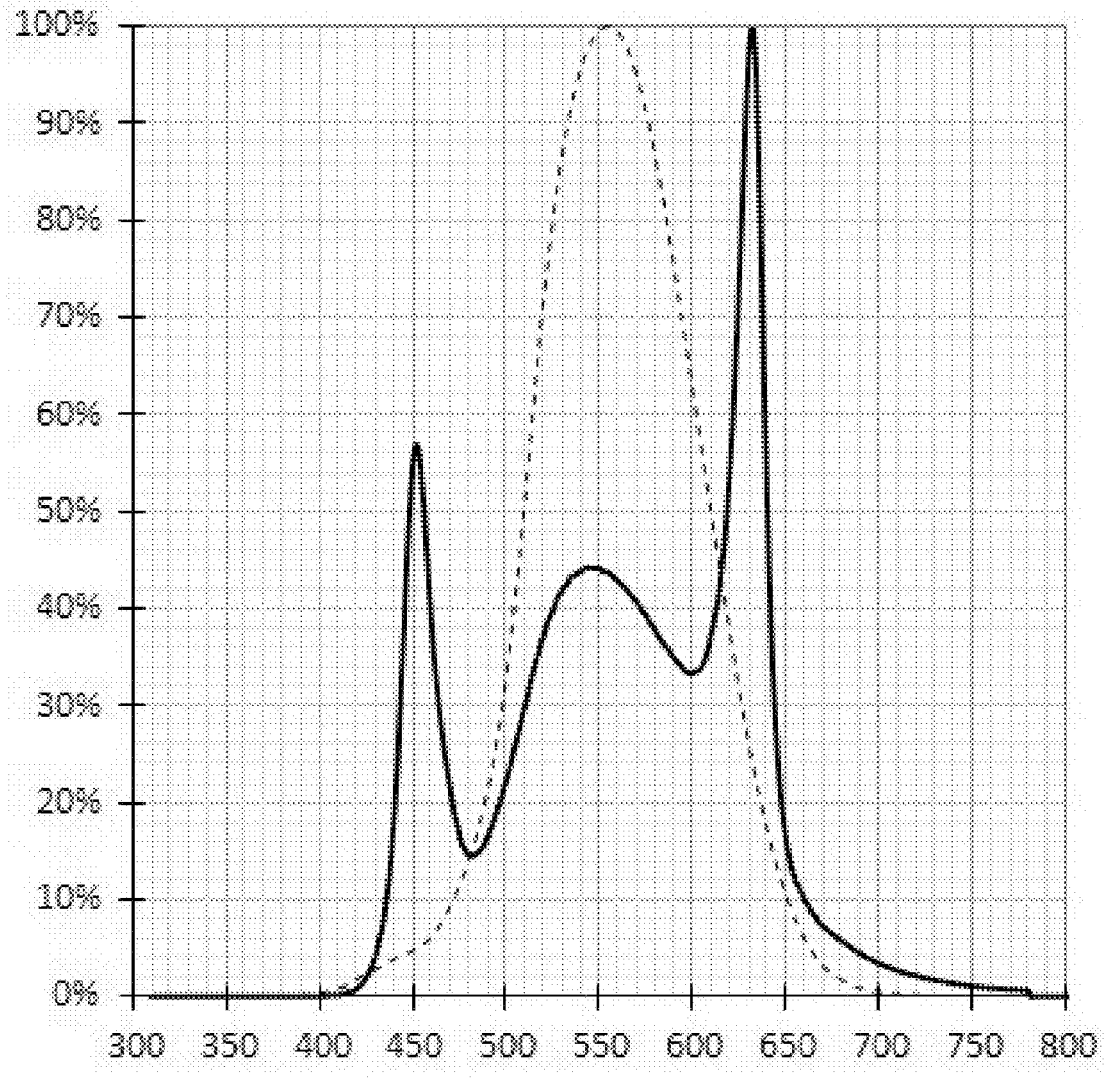
FIG. 23 is a plot of relative spectral power (percent) versus wavelength resulting from the simulation of FIGS. 19A-19C.

FIG. 23 is a plot of relative spectral power (percent) versus wavelength resulting from the simulation of FIGS. 19A-19C.

Figure 24A:
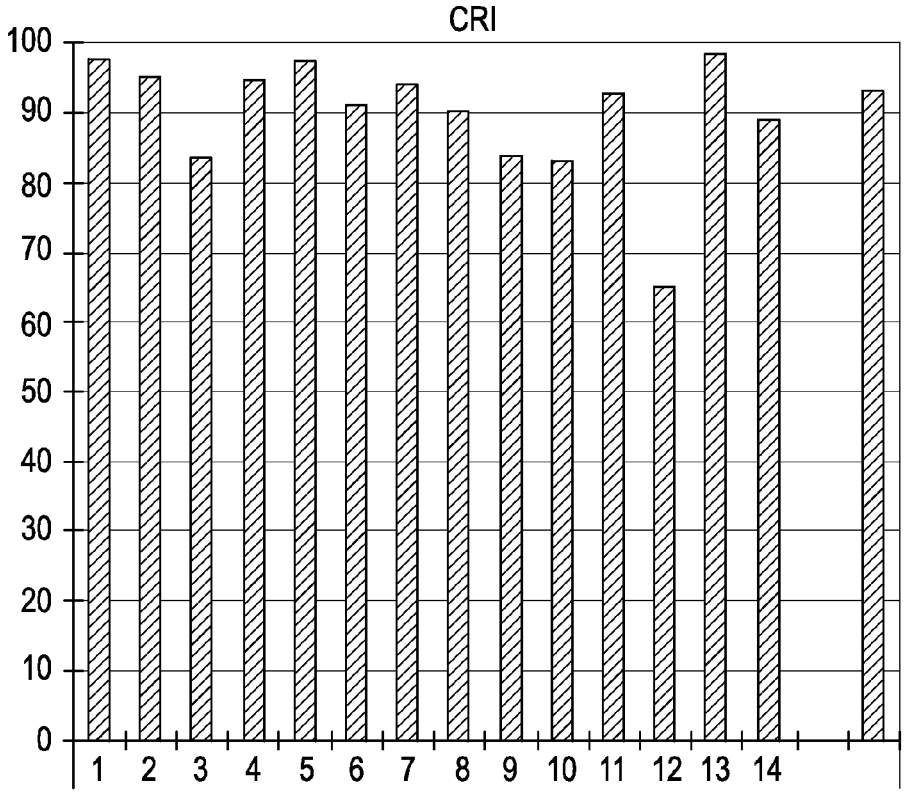
FIG. 24A is a bar chart embodying Color Rendering Index (CRI) performance for the simulation of FIGS. 19A-19C.
Figure 24B:
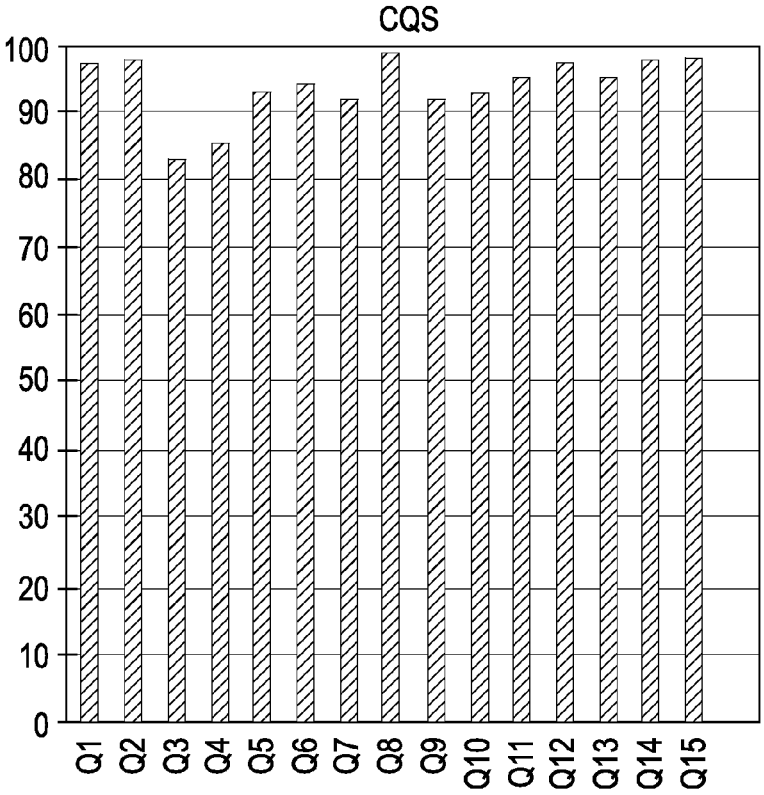
FIG. 24B is a bar chart embodying Color Quality Scale (CQS) performance for the simulation of FIGS. 19A-19C.

FIG. 24A is a bar chart embodying Color Rendering Index (CRI) performance for the simulation of FIGS. 19A-19C. The rightmost bar of FIG. 24A embodies CRI Ra, with a value greater than 90. FIG. 24B is a bar chart embodying Color Quality Scale (CQS) performance for the simulation of FIGS. 19A-19C. As shown in FIG. 24B, the values for Q1, Q2, and Q5 through Q15 are greater than 90, and the values for Q3 and Q4 are greater than 80.

Certain embodiments of the invention are directed to methods for illuminating an object, a space, or an environment, utilizing at least one lighting device as described herein.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures described herein are contemplated and will be apparent to a skilled person having knowledge of this disclosure. Any of the various features and elements as disclosed herein may be combined with one or more other disclosed features and elements unless indicated to the contrary herein. Correspondingly, the invention as hereinafter claimed is intended to be broadly construed and interpreted, as including all such variations, modifications and alternative embodiments, within its scope and including equivalents of the claims.

What is claimed is:

1. A lighting device comprising:

at least one first light emitting component including at least one electrically activated first solid state light emitter adapted to emit a peak wavelength in a range of from 430 to 480 nm, and including at least one first wavelength conversion material covering at least a portion of the at least one first solid state light emitter and adapted to emit a peak wavelength in a range of from 550 to 599 nm;

a second wavelength conversion material spatially segregated from the at least one first light emitting component, arranged to receive emissions from the at least one first light emitting component, and adapted to emit a peak wavelength in a range of from 500 to 560 nm; and an electrically activated second solid state light emitter adapted to emit a peak wavelength in a range of from 600 to 660 nm.

2. A lighting device according to claim 1, wherein the second wavelength conversion material is arranged to receive emissions from the second solid state light emitter.

3. A lighting device according to claim 1, wherein the second solid state light emitter is independently controllable relative to the at least one first solid state light emitter.

4. A lighting device according to claim 1, further comprising a third wavelength conversion material spatially segregated from the at least one first light emitting component, arranged to receive emissions from the at least one first light emitting component, and adapted to emit a peak wavelength in a range of from 600 to 660 nm.

5. A lighting device according to claim 4, wherein the second wavelength conversion material and the third wavelength conversion material are arranged within a single layer or dispersed within a unitary medium.

6. A lighting device according to claim 4, wherein the second wavelength conversion material is arranged in one conversion material layer, and the third wavelength conversion material is arranged in another, distinct conversion material layer.

7. A lighting device according to claim 4, wherein the second wavelength conversion material and the third wavelength conversion material are arranged over different areas of at least one lumiphor support element that is spatially segregated from the at least one first light emitting component.

8. A lighting device according to claim 7, wherein the different areas of at least one lumiphor support element are non-overlapping relative to one another.

9. A lighting device according to claim 4, wherein the second wavelength conversion material is arranged in or on a first lumiphor support element and the third wavelength conversion material is arranged in or on a second lumiphor support element, and wherein the first lumiphor support element and the second lumiphor support element are spatially segregated from the at least one first solid state light emitter.

10. A lighting device according to claim 1, wherein the at least one first wavelength conversion material is contained within a coating or binding medium, and the coating or binding medium is arranged in contact with the at least one first solid state light emitter.

11. A lighting device according to claim 1, further comprising a third solid state light emitter adapted to emit a peak wavelength in a range of from 481 to 499 nm.

12. A lighting device according to claim 11, wherein the third solid state light emitter is independently controllable relative to the at least one first solid state light emitter.

13. A lighting device according to claim 4, wherein:

the at least one first solid state light emitter includes multiple first solid state light emitters;

the second wavelength conversion material is arranged to receive emissions from one first solid state light emitter of the multiple first solid state light emitters; and the third wavelength conversion material is arranged to receive emissions from an other first solid state light emitter of the multiple first solid state light emitters.

14. A lighting device according to claim 13, wherein the other first solid state light emitter is independently controllable relative to the one first solid state light emitter.

15. A lighting device according to claim 7, wherein the at least one first solid state light emitter includes multiple first solid state light emitters;

the second wavelength conversion material is arranged to receive emissions from one first solid state light emitter of the multiple first solid state light emitters; and the third wavelength conversion material is arranged to receive emissions from an other first solid state light emitter of the multiple first solid state light emitters.

16. A lighting device according to claim 1, wherein aggregated emissions from the lighting device produce a mixture of light having x, y coordinates on a 1931 CIE Chromaticity Diagram that define a first point within four MacAdam ellipses of a reference point on the blackbody locus of a 1931 CIE Chromaticity Diagram.

17. A lighting device according to claim 16, wherein the reference point has a color temperature of less than or equal to 4000 K.

18. A lighting device according to claim 16, wherein the reference point has a color temperature of less than or equal to 3500 K.

19. A lighting device according to claim 1, wherein the second wavelength conversion material is adapted to emit a peak wavelength in a range of from 500 to 549 nm.

20. A lighting device according to claim 1, comprising at least one of a lens, a diffuser, and a scattering material arranged to receive emissions from the at least one first light emitting component and the second wavelength conversion material.

21. A lighting device according to claim 2, comprising at least one of the following features (i) to (iv):

(i) a single leadframe arranged to conduct electrical power to the second solid state light emitter and the at least one first solid state light emitter;

(ii) a single reflector arranged to reflect at least a portion of light emanating from the second solid state light emitter and the at least one first solid state light emitter;

(iii) a single submount supporting the second solid state light emitter and the at least one first solid state light emitter; and (iv) a single lens arranged to transmit at least a portion of light emanating from each of the second solid state light emitter and the at least one first solid state light emitter.

22. A lighting device according to claim 1, wherein combined emissions from the lighting device embody at least one of (a) a color rendering index (CRI Ra) value of at least 85, and (b) a color quality scale (CQS) value of at least 85.

23. A method comprising illuminating an object, a space, or an environment, utilizing a lighting device according to claim 1.

24. A lighting device comprising:

at least one first light emitting component including at least one electrically activated first solid state light emitter and a first wavelength conversion material covering at least a portion of the at least one first solid state light emitter, wherein a combination of light exiting the at least one first light emitting component including emissions generated by the at least one first solid state light emitter and the at least one first wavelength conversion material produces a mixture of light having x, y coordinates on a 1931 CIE Chromaticity Diagram that define a first point within ten MacAdam ellipses of at least one first reference point on the blackbody locus of a 1931 CIE Chromaticity Diagram;

a second wavelength conversion material spatially segregated from the at least one first light emitting component, arranged to receive emissions from the at least one first light emitting component and responsively convert a portion of the emissions from the at least one first light emitting component to generate second wavelength conversion material emissions; and at least one of the following items (a) and (b):

(a) an electrically activated second solid state light emitter adapted to emit a peak wavelength differing from (i) a peak wavelength of the at least one first solid state light emitter, (ii) a peak wavelength of the at least one first wavelength conversion material, and (iii) a peak wavelength of the second wavelength conversion material; and (b) a third wavelength conversion material spatially segregated from the at least one first light emitting component, arranged to receive emissions from the at least one first light emitting component and responsively convert a portion of the emissions from the at least one first light emitting component to generate third wavelength conversion material emissions including a peak wavelength differing from (i) a peak wavelength of the at least one first solid state light emitter, (ii) a peak wavelength of the at least one first wavelength conversion material, and (iii) a peak wavelength of the second wavelength conversion material;

wherein a combination of light exiting the lighting device produces a mixture of light having x, y coordinates on a 1931 CIE Chromaticity Diagram that define a second point within four MacAdam ellipses of at least one second reference point on the blackbody locus of a 1931 CIE Chromaticity Diagram, and wherein a color temperature of the first reference point is at least 1000 K greater than a color temperature of the second reference point.

25. A lighting device according to claim 24, comprising a second solid state light emitter adapted to emit a peak wavelength differing from (i) the peak wavelength of the at least one first solid state light emitter, (ii) the peak wavelength of the at least one first wavelength conversion material, and (iii) the peak wavelength of the second wavelength conversion material.

26. A lighting device according to claim 25, wherein the second solid state emitter is independently controllable relative to the at least one first solid state light emitter.

27. A lighting device according to claim 25, wherein the second solid state light emitter is adapted to emit a peak wavelength in a range of from 600 to 660 nm.

28. A lighting device according to claim 24, comprising a third wavelength conversion material spatially segregated from the at least one first light emitting component, arranged to receive emissions from the at least one first light emitting component and responsively convert a portion of the emissions from the at least one first light emitting component to generate third wavelength conversion material emissions including a peak wavelength differing from (i) the peak wavelength of the at least one first solid state light emitter, (ii) the peak wavelength of the at least one first wavelength conversion material, and (iii) the peak wavelength of the second wavelength conversion material.

29. A lighting device according to claim 28, wherein the third wavelength conversion material is adapted to emit a peak wavelength in a range of from 600 to 660 nm.

30. A lighting device according to claim 28, wherein the second wavelength conversion material and the third wavelength conversion material are arranged within a single layer or dispersed within a unitary medium.

31. A lighting device according to claim 28, wherein the second wavelength conversion material is arranged in one conversion material layer, and the third wavelength conversion material is arranged in another, distinct conversion material layer.

32. A lighting device according to claim 28, wherein the second wavelength conversion material and the third wavelength conversion material are arranged over different areas of at least one lumiphor support element that is spatially segregated from the at least one first light emitting component.

33. A lighting device according to claim 32, wherein the different areas of at least one lumiphor support element are non-overlapping relative to one another.

34. A lighting device according to claim 28, wherein the second wavelength conversion material is arranged in or on a first lumiphor support element and the third wavelength conversion material is arranged in or on a second lumiphor support element, and wherein the first lumiphor support element and the second lumiphor support element are spatially segregated from the at least one first light emitting component.

35. A lighting device according to claim 24, wherein the at least one first wavelength conversion material is contained within a coating or binding medium, and the coating or binding medium is arranged in contact with the at least one first solid state light emitter.

36. A lighting device according to claim 24, wherein:

the at least one first solid state emitter includes at least one first solid state emitter adapted to emit a peak wavelength in a range of from 430 to 480 nm;

the at least one first wavelength conversion material is adapted to emit a peak wavelength in a range of from 550 to 590 nm; and the second wavelength conversion material has a peak wavelength in a range of from 500 to 560 nm.

37. A lighting device according to claim 24, further comprising a third solid state light emitter adapted to emit a peak wavelength in a range of from 481 to 499 nm.

38. A lighting device according to claim 24, comprising at least one of a lens, a diffuser, and a scattering material arranged to receive emissions from the second wavelength conversion material and the at least one first light emitting component.

39. A lighting device according to claim 25, comprising at least one of the following features (i) to (iv):

(i) a single leadframe arranged to conduct electrical power to the second solid state light emitter and the at least one first solid state light emitter;

(ii) a single reflector arranged to reflect at least a portion of light emanating from the second solid state light emitter and the at least one first solid state light emitter;

(iii) a single submount supporting the second solid state light emitter and the at least one first solid state light emitter; and (iv) a single lens arranged to transmit at least a portion of light emanating from each of the second solid state light emitter and the at least one first solid state light emitter.

40. A lighting device according to claim 28, wherein:

the at least one first solid state light emitter includes multiple first solid state light emitters;

the second wavelength conversion material is arranged to receive emissions from one first solid state light emitter of the multiple first solid state light emitters; and the third wavelength conversion material is arranged to receive emissions from an other first solid state light emitter of the multiple first solid state light emitters.

41. A lighting device according to claim 40, wherein the other first solid state light emitter is independently controllable relative to the one first solid state light emitter.

42. A lighting device according to claim 32, wherein the at least one first solid state light emitter includes multiple first solid state light emitters;

the second wavelength conversion material is arranged to receive emissions from one first solid state light emitter of the multiple first solid state light emitters; and the third wavelength conversion material is arranged to receive emissions from an other first solid state light emitter of the multiple first solid state light emitters.

43. A lighting device according to claim 24, wherein combined emissions from the lighting device embody at least one of (a) a color rendering index (CRI Ra) value of at least 85, and (b) a color quality scale (CQS) value of at least 85.

44. A lighting device according to claim 24, wherein the second reference point is less than 4000 K.

45. A lighting device according to claim 24, wherein the second reference point is less than 3500 K.

46. A method comprising illuminating an object, a space, or an environment, utilizing a lighting device according to claim 24.

47. A lighting device comprising:

a first light emitting component including an electrically activated first solid state light emitter adapted to emit a peak wavelength in a range of from 430 to 480 nm, and including a first wavelength conversion material covering at least a portion of the first solid state light emitter and adapted to emit a peak wavelength in a range of from 550 to 599 nm;

a second light emitting component including an electrically activated second solid state light emitter adapted to emit a peak wavelength in a range of from 430 to 480 nm, and including a second wavelength conversion material covering at least a portion of the second solid state light emitter and adapted to emit a peak wavelength in a range of from 550 to 599 nm;

a third wavelength conversion material spatially segregated from the first light emitting component, arranged to receive emissions from the first light emitting component, and adapted to emit a peak wavelength in a range of from 500 to 549 nm; and a fourth wavelength conversion material spatially segregated from the second light emitting component, arranged to receive emissions from the second light emitting component, and adapted to emit a peak wavelength in a range of from 600 to 660 nm.

48. A lighting device according to claim 47, wherein the first light emitting component and the second light emitting component are independently controllable relative to one another.

49. A lighting device according to claim 47, comprising at least one of a lens, a diffuser, and a scattering material arranged to receive emissions from the first and the second light emitting component and from the third and the fourth wavelength conversion material.

50. A lighting device according to claim 47, comprising at least one of the following features (i) to (iv):

(i) a single leadframe arranged to conduct electrical power to the first solid state light emitter and the second solid state light emitter;

(ii) a single reflector arranged to reflect at least a portion of light emanating from the first solid state light emitter and the second solid state light emitter;

(iii) a single submount supporting the first solid state light emitter and the second solid state light emitter; and (iv) a single lens arranged to transmit at least a portion of light emanating from each of the first solid state light emitter and the second solid state light emitter.

51. A lighting device according to claim 47, wherein aggregated emissions from the lighting device produces a mixture of light having x, y coordinates on a 1931 CIE Chromaticity Diagram that define a first point within four MacAdam ellipses of a reference point on the blackbody locus of a 1931 CIE Chromaticity Diagram.

52. A lighting device according to claim 51, wherein the reference point has a color temperature of less than or equal to 4000 K.

53. A lighting device according to claim 51, wherein the reference point has a color temperature of less than or equal to 3500 K.

54. A lighting device according to claim 47, wherein combined emissions from the lighting device embody at least one of (a) a color rendering index (CRI Ra) value of at least 85, and (b) a color quality scale (CQS) value of at least 85.

55. A method comprising illuminating an object, a space, or an environment, utilizing a lighting device according to claim 47.

56. A method according to claim 55, comprising adjusting supply of power to the first solid state light emitter and the second solid state light emitter to adjust any of chromaticity, color temperature, and intensity of aggregate emissions from the lighting device.

* * * * *